US009815089B2

(12) United States Patent
Stemmle

(10) Patent No.: US 9,815,089 B2
(45) Date of Patent: Nov. 14, 2017

(54) ESCORT BASED SORTING SYSTEM FOR MAIL SORTING CENTERS

(71) Applicant: LOCKHEED MARTIN CORPORATION, Bethesda, MD (US)

(72) Inventor: Denis J. Stemmle, Stratford, CT (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 15 days.

(21) Appl. No.: 14/938,167

(22) Filed: Nov. 11, 2015

(65) Prior Publication Data

US 2016/0059268 A1 Mar. 3, 2016

Related U.S. Application Data

(60) Continuation of application No. 14/312,965, filed on Jun. 24, 2014, now Pat. No. 9,227,227, which is a (Continued)

(51) Int. Cl.
*B07C 3/08* (2006.01)
*B07C 3/00* (2006.01)

(52) U.S. Cl.
CPC ..... *B07C 3/08* (2013.01); *B07C 3/00* (2013.01); *B07C 3/082* (2013.01)

(58) Field of Classification Search
CPC ..... B07C 3/003; B07C 3/006; B07C 3/08; B07C 3/082; B07C 3/085; B65G 2201/0285
See application file for complete search history.

(56) References Cited

U.S. PATENT DOCUMENTS 3,032,341 A 5/1962 Reist
3,884,370 A * 5/1975 Bradshaw ..... B07C 3/087 198/350

(Continued)

FOREIGN PATENT DOCUMENTS

WO WO2006/063204 6/2006

OTHER PUBLICATIONS

Notice of Allowance dated Oct. 27, 2015 in related U.S. Appl. No. 14/312,965, 19 pages.

(Continued)

*Primary Examiner* — Joseph C Rodriguez
(74) *Attorney, Agent, or Firm* — Kent E. Kemeny; Andrew M. Calderon; Roberts Mlotkowski Safran Cole & Calderon P.C.

(57) ABSTRACT

An Escort-Based Sorting (EBS) mail sorting and distribution center system configured and controlled for optimum mail flow and dispatch, minimal sorting center space usage, and elimination of peripheral storage and retrieval equipment. A plurality of input stations each include a mechanism for loading mailpieces and obtaining mailpiece data. A plurality of sorting banks each having a plurality of sorting modules, each sorting module adapted for the face-to-face conveyance of mailpieces for sorting by transferring select mailpieces from a first to a second conveyance path. The sorting modules define at least one row and a plurality tiers operatively coupled by a plurality of elevators. The elevators move mailpieces to and from tiers of the respective sorting bank. A system controller, operatively coupled to the input stations, sorting banks, and elevators, creates an association between the mailpiece information and the escort device, and sorts and dispatches mailpieces according to a dispatch schedule.

19 Claims, 17 Drawing Sheets

Related U.S. Application Data division of application No. 12/935,460, filed as application No. PCT/US2008/059902 on Apr. 10, 2008, now Pat. No. 8,766,128.

(56) References Cited

U.S. PATENT DOCUMENTS

| | | | |
|---|---|---|---|
| 3,904,027 | A | 9/1975 | Gilles et al. |
| 3,960,264 | A | 6/1976 | Carbine et al. |
| 4,169,529 | A | 10/1979 | Hunter |
| 4,244,672 | A | 1/1981 | Lund |
| 6,003,859 | A | 12/1999 | Reist |
| 6,674,038 | B1 | 1/2004 | Latta |
| 7,138,596 | B2 | 11/2006 | Pippin et al. |
| 8,041,452 | B2 | 10/2011 | Park et al. |
| 8,369,985 | B2 | 2/2013 | Stemmle |
| 8,374,720 | B2 | 2/2013 | Kechel |
| 8,457,781 | B2 | 6/2013 | Bailey et al. |
| 8,731,707 | B2 | 5/2014 | Stemmle |
| 8,766,128 | B2 | 7/2014 | Stemmle |
| 8,955,688 | B2 | 2/2015 | Berdelle-Hilge |
| 8,965,566 | B2 | 2/2015 | Berdelle-Hilge |
| 9,227,227 | B2 * | 1/2016 | Stemmle ..... B07C 3/00 |
| 9,314,822 | B2 * | 4/2016 | Berdelle-Hilge ..... B07C 3/00 |
| 2002/0083021 | A1 | 6/2002 | Ryan et al. |
| 2005/0044560 | A1 | 2/2005 | Kryeziu |
| 2007/0131593 | A1 | 6/2007 | Burns et al. |
| 2007/0273086 | A1 | 11/2007 | Stemmle |
| 2008/0011653 | A1 | 1/2008 | Stemmle |
| 2008/0083662 | A1 | 4/2008 | Stemmle |
| 2008/0086232 | A1 | 4/2008 | Stemmle |
| 2008/0164185 | A1 | 7/2008 | Stemmle |
| 2009/0000996 | A1 | 1/2009 | Stemmle |
| 2010/0049360 | A1 | 2/2010 | Stemmle |

OTHER PUBLICATIONS

Written Opinion of International Searching Authority for International Application No. PCT/US2008/059902 dated Nov. 18, 2008.

* cited by examiner

ESCORT BASED SORTING SYSTEM FOR MAIL SORTING CENTERS

TECHNICAL FIELD

The present invention relates to automated mailpiece sorting apparatus, and, more particularly, to a new and useful escort-based sorting system for processing mail received and dispatched from mail sorting centers and delivery offices.

BACKGROUND OF THE INVENTION

In centralized postal sorting centers, a RADIX sorting algorithm is typically employed to sort incoming mail. This sorting algorithm requires that mail be passed through the automated sorting system several times to place the mail in a sequence corresponding to the delivery route taken by a mail carrier, i.e., sorted to delivery sequence. This sorting algorithm requires that a precise order be maintained with each pass through the sorting system. Operators must remove and store mail following one sorting sequence and return the mail to the sorter in the correct order to ensure that the RADIX sorting algorithm has not been compromised.

FIG. 1 is a schematic illustration of a conventional large scale sorting center 200 employed in most cities and states across the U.S. Mail 202 arrives at various times each day and must be periodically and routinely loaded onto trucks 204 by a particular dispatch time for delivery to other sorting centers and various postal offices. Due to the large number of mailpieces 202 sorted at a typical sorting center, multiple sorters 206, 208, i.e., flats sorters 206 and letter sorters 208, are employed to handle the daily volume of incoming mail. The mail 202 is often transported and stored via a tray storage and retrieval system 210 before, during and after each sortation sequence. That is, to facilitate transport, storage and delivery, the sorting centers are typically equipped with miles of conveyor systems, robotic tray handling mechanisms, hundreds of forklifts/lifting/retrieving apparatus and hundreds of operators for the purpose of loading, unloading, tracking, traying and delivering the mail each day. Those sorting centers that have less invested in automated equipment often employ an even greater number of staff/personnel to manage the workflow.

Accordingly, it will be appreciated that such sorting centers: (i) require a significant quantity of costly peripheral equipment, (ii) require many operators to orchestrate the flow of mail into and out of the center and (iii) occupy a significant footprint/area in terms of real estate required to house such a large quantity of equipment and personnel. With respect to the latter, floor space is required to: (a) transport the mail to and from the tray storage and retrieval system 210, (b) house the many palettes of mail trays at the input and output areas, 212 and 214, respectively and (c) produce wide aisle ways for the passage of forklifts and other transport vehicles.

The typical or average sorting center in the United States Postal Service (USPS) system receives and sorts mail for about 713 routes and delivers the sorted mail to about 35 delivery offices. Each delivery office typically processes mail for delivery to an average of about 20-30 routes. The mail received by the sorting center may be categorized as mail (i) arriving via USPS from other sorting centers, (ii) received from large volume/bulk mailers which have been presorted to receive sorted mail discounts and (iii) mail gathered from conventional mailbox containers and/or delivery offices, i.e., collection mail. The mail is deposited at a first processing station 216 where pre-sorted mail may be moved either to the storage and retrieval system 210 or to one of the flats or letter sorting stations 206, 208. Collection mail is typically moved to a second processing station 218 and is categorized as either: machineable or non-machineable, flats-type or letter-type, and inbound or outbound mail. Having been sorted into groups, the collection mail is conveyed to either: the flats sorter, 206, the letter sorter 208, the storage and retrieval system 210, the facer/canceller system 32 or to a manual sorting station 220. Typically, about twenty percent (20%) of the total mail ingested is non-machineable, and must, therefore, be sorted manually by operators at several manual sorting stations 220.

While the investments made in automation have vastly improved sorting center operations, these investments have focused on discrete portions of the work flow e.g., transport, storage, retrieval, loading, sorting, etc. Consequently, a significant amount of manual handling still remains for the purpose of moving mail to and from each of the automated cells or operations. For example, in some sorting centers, despite the investments in automation, mail is manually handled as frequently as seventeen (17) times from the point of entry 212 to the dispatch area 214.

Further discussion of sorting center operations and an escort-based sorting system are described in commonly-owned, co-pending U.S. patent application Ser. No. 11/544,349, filed 6 Oct. 2006 entitled "Mail Sorter System and Method for Productivity Optimization Through Precision Scheduling" and U.S. patent application Ser. No. 11/544,184 filed 6 Oct. 2006 entitled "Mail Sorter System and Method for Moving Trays of Mail to Dispatch in Delivery Order" which are both incorporated herein by reference in their entirety. Examples of an escort-based system can be found in International Application WO 2006/063204 filed 7 Dec. 2005 entitled "System and Method for Full Escort Mixed Mail Sorter Using Clamps" and can also be found in U.S. Provisional application Ser. No. 11/519,630 filed 12 Sep. 2006 titled "Sorter, Method, and Software Product for a Two-Step and One-Pass Sorting Algorithm," which are also incorporated herein by reference in their entirety. The concepts of macro-sorting are described, for example, in U.S. Provisional Application No. 60/669,340 filed 5 Apr. 2005, titled "Macro Sorting System and Method" which also is incorporated herein by reference in its entirety.

In addition to the lack of efficiency and cost associated with prior art sorting centers, escort-based sorters such as those referenced in the prior are limited in their ability to divert/transfer articles from one conveyance path to another. For example, certain sorting arrangements could benefit from a third conveyance path, e.g., a path adjacent first and second paths, to minimize the overall length and width of the escort-based sorter. However, the conveyance/diverter systems employed in prior art escort-based sorters are limited to the transfer of the escort device between adjacent pairs of conveyance paths, i.e., between first and second paths. To transfer/divert an escort device to yet another path, i.e., a third path, requires that the additional path be located downstream of the first and second paths. As such, the overall length of the escort-based sorter is increased.

In addition to the penalties in the space requirements, the efficiency of the escort based sorter is reduced or further compromised. That is, it will be appreciated that by increasing the length of the conveyance/diverter system, the time required for dispatch, i.e., to move an escort device through the sorter, is also increased. Delays in dispatch adversely impact the time available to operate the sorter, and accordingly, reduces the number of mailpieces/articles which can be sorted within a predetermined time interval.

A need, therefore, exists for an escort-based sorting system for use in a sorting center which (i) sorts mail to delivery sequence, (ii) stores all incoming mail within the sorter during a specified time interval, e.g., over the course of a twenty-four hour time period, without the need to remove, transport, store and retrieve the mail, (iii) simultaneously and/or continuously sorts inbound and outbound mail (iv) enables conveyance and transfer between multiple adjacent paths, (v) facilitates reliable transfer of escorted mailpieces across multiple interfaces (vi) optimizes the storage and utilization of space within the sorting center to reduce its footprint and/or space requirements, (vii) dispatches mail from the sorter while continuing to sort incoming mail, (viii) communicates the status of outbound mail to other sorting centers to enable improved personnel planning and scheduling, and (ix) dispatches mail just-in-time to optimize the flow of mail processed through the sorting and sorting center.

SUMMARY OF THE INVENTION

An Escort-Based Sorting (EBS) system is provided for a mail sorting and distribution center which is configured and controlled to optimize the flow of dispatched mail, minimize the space occupied within the sorting center, and eliminate the requirement for peripheral storage and retrieval equipment. The EBS system includes a plurality of input stations each including a mechanism for loading mailpieces into an escort device and a device for obtaining mailpiece data associated with each mailpiece. The EBS system also includes a plurality of sorting banks each having a plurality of sorting modules. Each sorting module is adapted to move mailpieces along conveyance paths in face-to-face relation and is operative to sort mailpieces by transferring select mailpieces from a first conveyance path to a second conveyance path. Furthermore, the sorting modules are arranged to define at least one row and a plurality tiers which are operatively coupled by a plurality of elevators. The elevators are adapted to move the mailpieces to and from the each of the tiers of the respective sorting bank. Finally, a system controller is operatively coupled to the input stations, sorting banks and elevators, to create an association between the mailpiece information and the escort device, and sort the mailpieces and dispatch the mailpieces according to a dispatch schedule.

A conveyance/diverter system is also provided for an Escort Based Sorting (EBS) system including a plurality of escort devices for securing and transporting mailpieces. Each of the escort devices includes a mounting fixture defining at least two load bearing surfaces which are vertically-spaced and arranged to intersect a vertical line passing through the gravitational center of the escorted mailpiece. The conveyance/diverter system, furthermore, includes adjacent conveyance paths operative to transport the escorted mailpieces across an interface therebetween such that a first load bearing surface of the mounting fixture engages one of the conveyance paths during transport and a second load bearing surface of the mounting fixture engages the other conveyance path as the escort device traverses the interface.

A conveyance/diverter system is also provided for selectively transferring escorted mailpieces across multiple conveyance paths. The conveyance/diverter system includes a first path operative to receive escorted mailpieces to be sorted and stored in batches and a second path operative to dispatch escorted mailpieces previously stored and sorted. The system further includes a plurality of central paths disposed between the first and second paths wherein each of the central paths is operative to receive select escorted mailpieces from the first path, store the escorted mailpieces in batches, and convey the select escorted mailpieces to the second path during dispatch. In one embodiment, the central path comprises a pair of parallel diverter units and an accumulator therebetween for storing escorted mailpieces, while in another embodiment, the pair of diverter units are aligned and one of the diverter units is operative to store the escorted mailpieces.

BRIEF DESCRIPTION OF THE DRAWINGS

The accompanying drawings illustrate presently various embodiments of the invention, and assist in explaining the principles of the invention.

FIGS. 11*a*-11*d* depict various means for selectively conveying the mounting fixture/escort device across a plurality of adjacent conveyance/storage paths, wherein: FIG. 11*a* is a view taken substantially along a line 11*a*-11*a* of FIG. 10*a*, FIG. 11*b* is a view taken substantially along a line 11*b*-11*b* of FIG. 10*a*, FIG. 11*c* is a view taken substantially along a line 11*c*-11*c* of FIG. 10*a*, and FIG. 11*d* is a view taken substantially along a line 11*d*-11*d* of FIG. 10*a*.

DETAILED DESCRIPTION OF AN EMBODIMENT OF THE INVENTION

Figure 1:
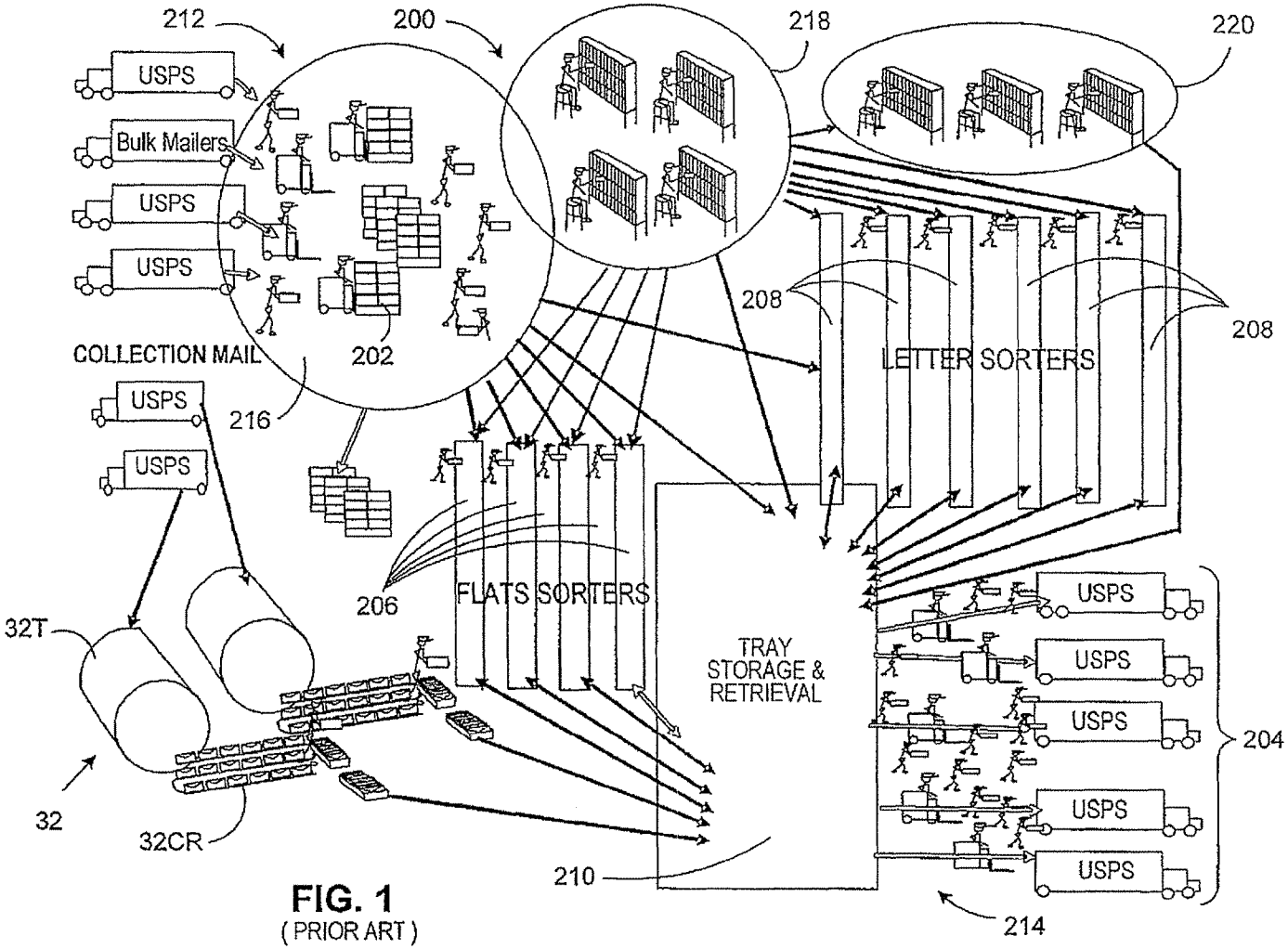
FIG. 1 (PRIOR ART)
FIG. 1 is a schematic illustration of a conventional mail sorting and sorting center employed in most cities and states across the United States of America.

The present invention will be described in the context of a sorting center having one or more Escort-Based Sorting (EBS) systems for processing mail during the course of a predetermined interval of time. While the invention is most applicable to a mail sorting and distribution center, it should be appreciated that the teachings of the present invention are equally applicable to any processing facility having a large quantity of mail to be sorted. Hence, in the context used herein the term "distribution center" means any facility including a sorting facility, delivery office, etc., which processes mail. Furthermore, while the EBS system is described in the context of an escort-based sorter employing a plurality of individual clamps, the teachings of the present invention are applicable to any escort-based sorting system which may employ any of a variety of holding devices for escorting mail within the sorting system.

More specifically, an escort-based sorting system may be defined as a system wherein individual mailpieces are retained by an escort mechanism and wherein at least a portion of the sorting operations is conducted by a system which interacts with the escort mechanism without contacting the mailpiece itself. Typically, destination information on the mailpiece is captured/stored in a database and an association is made between the mailpiece and a unique identifier on the escort mechanism (discussed and illustrated hereinafter).

Multi-Phase Sorting Operations

The EBS system processes mail over the course of an interval of time which includes at least two phases, i.e., a first and second phase. During these phases mail is loaded, stored, sorted in, and dispatched from, the EBS system. In the described embodiment, the time interval is a twenty-four (24) hour period, a single day or a portion of a day, with the first phase typically occurring over about a twenty-one (21) hour time period and the second phase spanning the remaining portion, or about a three (3) hour time interval. In terms of the time of day, the twenty-four (24) hour period may extend from 6:00 AM on one day to 6:00 AM the following day, with the first phase ending at about 3:00 AM the next day, and the second phase spanning the remaining period, or from about 3:00 AM to about 6:00 AM the following day. As discussed in commonly-owned U.S. patent application Ser. No. 11/544,349 and Ser. No. 11/544,184, the exact time required for the first and second phases can be calculated from the volume of mail processed. In general, the sum of the first and second phases will equal the predetermined time interval.

With respect to the sorting procedure, inbound and outbound mail are co-mingled upon being initially loaded into the sorter and are sorted during the first phase. Inbound mail is sorted to large batches, e.g., approximately six-hundred (600) destination addresses each having approximately five (5) mailpieces to be delivered. Outbound mail, on the other hand, may be sorted to its subsequent sorting center/delivery office destination. Hence, inbound mail is only partially sorted during the first phase, and further processing is required to sort the mail to delivery sequence, i.e., sorted according to the planned delivery route of a mail carrier. Outbound mail may be sorted to its subsequent destination and no further sorting is required at the present sorting center.

Depending upon the requisite dispatch time and/or schedule, the EBS system dispatches the currently accumulated outbound mail at the appropriate time. i.e., taking into consideration the time required to: (i) unload the mail from the EBS system, (ii) load the mail onto delivery trucks, and (iii) travel to its final destination. Consequently, the first phase of sorting operations is characterized by a first sorting operation wherein: (i) inbound mail is sorted to large batches, i.e., which may contain an average about three-thousand 3000 mailpieces (600 destinations×5 mailpieces per destination), (ii) outbound mail is sorted to its distribution or delivery office destination and, (iii) outbound mail is dispatched according to a dispatch schedule.

In the second phase, inbound mail is sorted from large batches to small batches and, subsequently, each small batch is sorted to delivery sequence. A small batch may include approximately twenty-five (25) destination addresses each having approximately five (5) mailpieces to be delivered. Consequently, a small batch may comprise a total of about one-hundred and twenty-five (125) mailpieces. The second phase of sorting operations is, therefore, characterized by a second sorting operation wherein: (i) inbound mail is sorted to delivery sequence (i.e., initially into groups of small batches and finally to delivery sequence), (ii) inbound mail is dispatched according to a predetermined dispatch schedule, and (iii) outbound mail is also dispatched according to the dispatch schedule for outbound mail. Consequently, inbound mail is dispatched in the second phase of sorting operations while outbound mail may be dispatched at any time over the course of the predetermined time interval, i.e., either in the first and/or second phases of sorting operations.

Mail Piece Input

Figure 2:
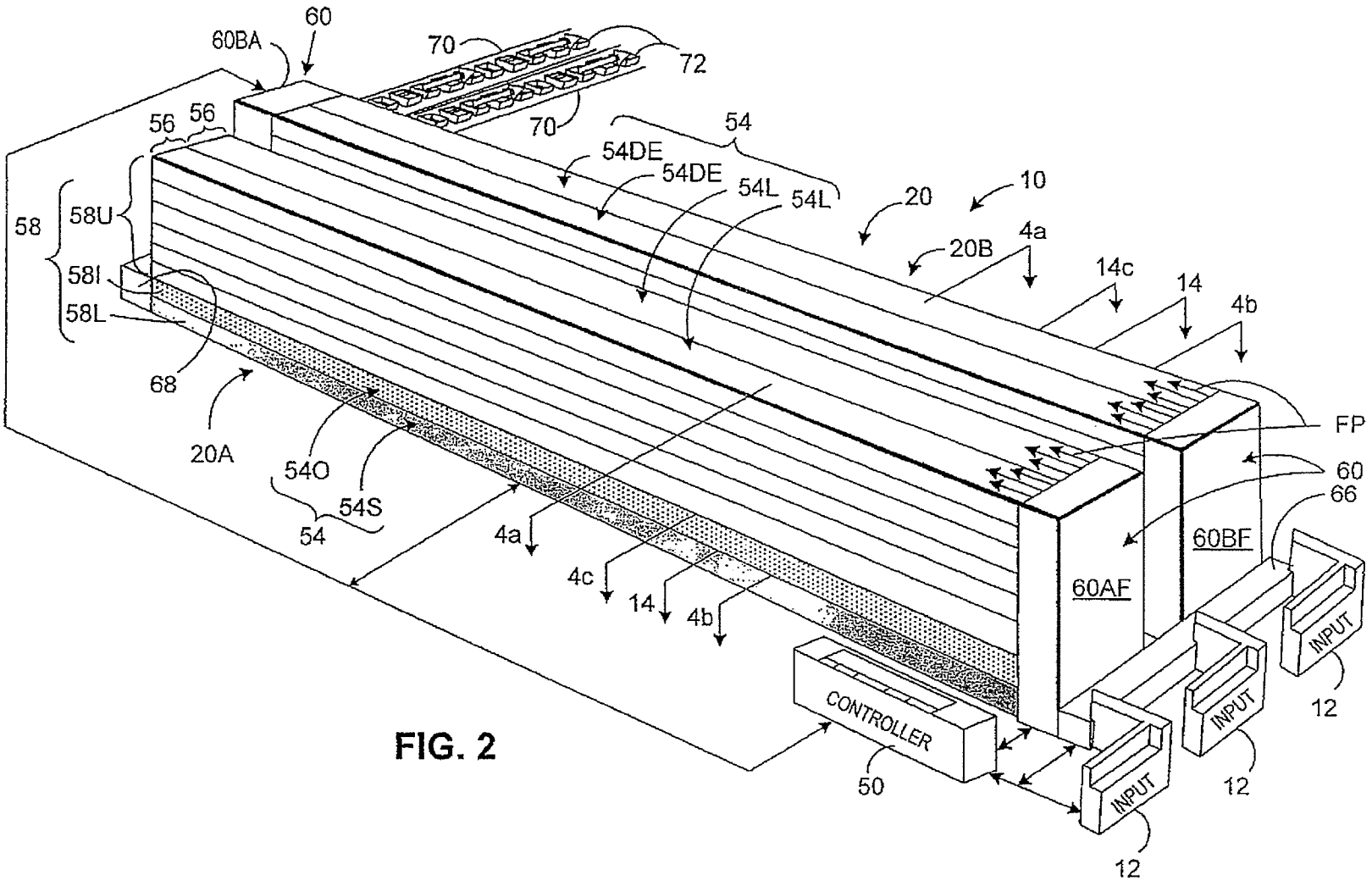
FIG. 2 depicts a pair of adjacent sorting banks employed in the Escort Based Sorting (EBS) system of the present invention, each sorting bank including a plurality of sorting modules which are arranged in tandem and stacked vertically to define a plurality of rows and tiers.
Figure 3:
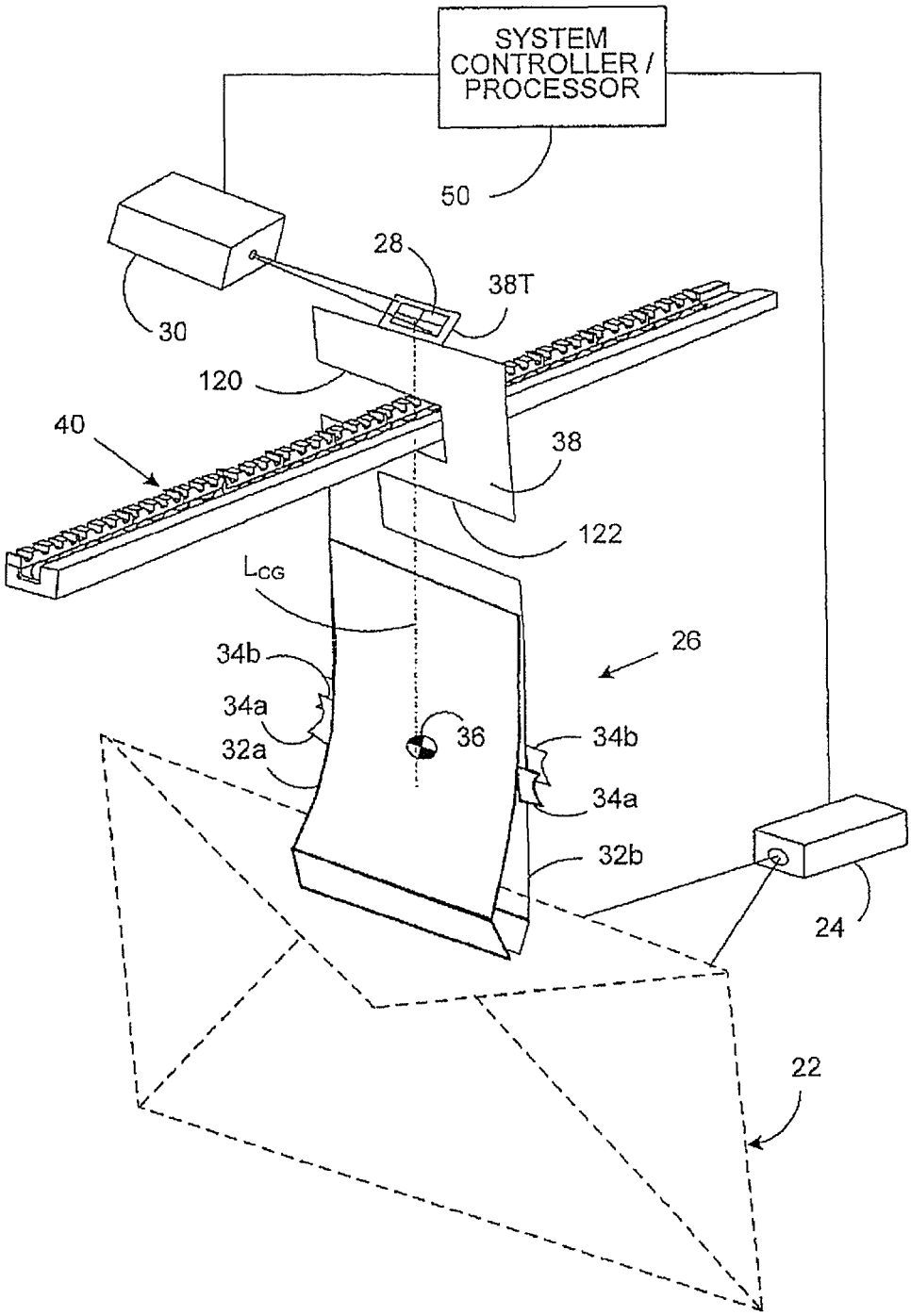
FIG. 3 is an isolated perspective view of an escort device for use in an Escort-Based Sorting (EBS) system.

As mentioned in the background of the invention, mailpieces are received at a sorting center from a variety of input sources including mail from other sorting centers, trayed mail from commercial service providers, e.g., bulk mailers, and collection mail. In FIGS. 2 and 3, mail may be unloaded at a sorting center 10 and loaded into a plurality of input stations 12. In the context used herein, each input station 12 may perform several operations and may include various distinct/separate systems. The elements of an input station 12 may include: (i) a means (not shown) for singulating mailpieces 22 from a tray or batch of mail, (ii) a means for reading, e.g., a first optical scanning device 24, destination information contained on each mailpiece 22, (iii) a means (not shown) for loading mailpieces 22 into an escort device 26 having a unique identifier 28 and (iv) a means for capturing/reading, e.g., a second optical scanning device 30, the unique identifier of the escort device 26.

In one embodiment of the invention, mailpieces may be oriented and singulated by a conventional facer/canceller 32 (see FIG. 1). Therein, mailpieces are placed in a cylindrical tumbler 32T having a plurality of slots or openings which facilitate singulation and orientation of the mailpieces. That is, mailpieces exit through slots/openings in the tumbler 32T and placed in tandem or on-edge into a canceller/reader 32CR. In the canceller/reader 32CR, the postage is cancelled. In conventional sorting centers, cancelled mail is manually loaded into trays which are then placed on a conveyor for subsequent processing. In the present invention, while the mail is in the facer/canceller 32, it remains singulated. The mailpiece information, e.g., the destination address, may, at this time, be scanned by the first optical scanning device 24. Thereafter, each mailpiece 22 may be directed from the canceller/reader 32CR and loaded into the escort device 26.

In another embodiment of the invention, mailpieces may be manually stacked edgewise on a conveyor deck and fed to a singulating device. Once singulated, the mailpiece is carried to the first optical scanning device 24 to obtain the mailpiece destination information. Thereafter, each mailpiece 22 may be loaded into the escort device 26. Additionally, singulation may be performed manually when the mail is not suited for automated processing.

Loading Mailpieces

In FIG. 3, the escort device 26 may include a clamp having a pair of jaws 32*a*, 32*b*. The jaws 32*a*, 32*b* are spring-biased to a closed position and must be spread apart to accept an edge/end of the mailpiece 22. The mailpieces 22 may be letters, flats, periodicals, brochures, catalogs, newspapers, postcards, magazines and the like, intermixed in any order. In the case of uncontained or loose mailpieces 22, such as a magazine or newspaper, a binding wrap or enclosure (not shown) may be employed to encapsulate/contain the unbound edge. Alternatively, the bound edge may be inserted into the jaws 32*a*, 32*b*, such that the unbound edge faces downwardly to remain closed due to gravitational forces.

While the mailpiece 22 is shown in a downward position, i.e., hanging from a conveyor/diverter system 40, the jaws 32*a*, 32*b* may be initially oriented upwardly for accepting the mailpiece 22 during loading operations. A mechanism (not shown) opens and closes the jaws 32*a*, 32*b* for accepting/retaining each mailpiece 22 therein. More specifically, each of the jaws 32*a*, 32*b* may include tabs 34*a*, 34*b* for engaging the forward and aft involute surfaces of a pair of threaded shafts/rods (not shown). The thickness and pitch of the threads vary along the length of each shaft/rod such that rotation thereof causes the tabs 34*a*, 34*b* to spread open to accept the mailpiece 22 between the jaws 32*a*, 32*b* of the clamp 26. As the shafts/rods continue to rotate, the tabs 34*a*, 34*b* engage one or more threads which decrease in thickness. The spring-bias forces generated by the clamp 26 causes the tabs 34*a*, 34*b*, and consequently, the jaws 32*a*, 32*b*, to close onto the face surfaces of the mailpiece and retain the mailpiece within the clamp 26. The mailpiece 22 may be centered within the clamp 26, i.e., along its centroid 36, to prevent moment loads from pivoting the clamp 26 about a hanger or mounting fixture 38, i.e., a square-S shaped element disposed above the jaws 32*a*, 32*b*.

A system and method for loading mailpieces 22 into an escort device is described in commonly-owned, co-pending U.S. Publication No. 2006/044560, filed 13 Jul. 2006 entitled "Apparatus and Method for Positioning Objects/Mailpieces". Furthermore, commonly-owned, co-pending U.S. Publication No. 2005/044560, filed 12 Jul. 2005 entitled "Full Escort Mixed Mail Sorter Using Clamps", and U.S. Publication No. 2005/044406, filed 12 Jul. 2005 entitled "Clamp for Mixed Mail Sorter" each describe a clamp useful for escorting mailpieces in an EBS system. The above-identified US patent applications are hereby incorporated by reference in their entirety.

The unique identifier 28 may be a unique number or barcode (one- or two-dimensional) located along a side edge of the S-shaped mounting fixture 38, or along an angled tab 38T projecting from an upper edge surface of the fixture 38. The step of capturing/reading the unique identifier 28 may be performed before, during, or after loading the mailpiece 22 into the escort device 26, although it will generally be performed at, or near, the same moment in time to ensure that an accurate association is made between the loaded mailpiece 22 and escort device 26. More specifically, a system controller 50 (see FIG. 2) correlates the mailpiece information with the unique identifier 28 such that the escort device 26 may be monitored/tracked within the EBS system 20 rather than a need to obtain tracking/sorting information directly from the mailpiece. Most importantly, however, sorting operations will be performed using the association between the mailpiece 22 and the escort device 26. While the system controller 50 may read the identifier 28 when the mailpieces are initially loaded, it should be appreciated that the identifier 28 may be read multiple times by multiple readers/scanning devices 30 during the course of sorting operations.

After feeding, scanning and interpreting the mailpieces 22 and loading each within an escort device 26 at the input stations 12, the system controller 50 begins to direct the sorting of ingested mailpieces 22. Before discussing the sorting operations and methodology, i.e., where and why mailpieces 22 are conveyed/transferred to a particular location, it will be useful to describe the remaining elements of the EBS system 20.

Sorting Banks

In FIGS. 2, 4*a*-4*c*, the EBS system 20 includes a plurality of sorting banks 20A, 20B which are comprised of a plurality of sorting modules 54. In the context used herein, the term "module" refers to a portion of the sorting bank which has common structure or feature. The various modules 54 can be integrated as building blocks within the sorting banks for increasing or decreasing the capacity of a sorting bank. More specifically, the sorting modules 54 are generally arranged in tandem to define rows 56 having a plurality of longitudinal conveyance/storage areas paths and are stacked to define a plurality of tiers 58. As will be discussed in further detail hereinafter, the rows 56 and tiers 58 are dedicated to performing specific sorting tasks and/or storage functions. The rows 56 and tiers 58 are operatively coupled by spiral elevators 60AF, 60BF (see FIG. 2) disposed at a forward end of each of the sorting banks 20A, 20B. While a spiral elevator may be configured to couple a plurality of sorting banks 20, i.e., convey mailpieces from one sorting bank 20A to another sorting bank 20B, in the described embodiment, a distribution system 66 is interposed between each input station 12 and the spiral elevators 60AF, 60B to convey mailpieces 22 to the sorting banks 20A, 20B. Furthermore, it should also be appreciated that each of the spiral elevators 60AF, 60BF may transfer mailpieces 22 bi-directionally such that mailpieces 22 may be elevated/loaded into the sorting modules 54, or declined/dispatched from the modules 54.

The sorting modules 54 of the present invention include several variants to refine the sorting operation. That is, the sorting modules 54 include sort-to-large batch modules 54L, sort-to-small batch modules 54S, sort-to-delivery sequence modules 54DS and sort-to-destination modules 54DE. Inasmuch as each of the modules 54L, 54S, 54DS, 54DE may also be viewed as containing one or more "storage areas" for mail, the terms, storage areas and modules may be used interchangeably hereinafter.

While all of the modules or areas 54L, 54S, 54DS, 54DE are slightly different in terms of the requirement for and/or number of transfer/diverter mechanisms, all employ a plurality of conveyance paths for moving mailpieces 22 in face-to-face relation along the length of each path. The sort-to-large batch modules 54L (see FIG. 4*a*) and sort-to-destination modules 54DE (FIGS. 4*a*-4*c*) are dedicated to simple linear movement and mailpiece storage. The sort-to-small batch modules 54S and sort-to-delivery sequence modules 54DS (see FIG. 4*b*) are, in addition to moving mail along various conveyance paths and providing an ability to store groups of mail, are also capable of diverting/transferring select mailpieces from one of the conveyance paths to another path to sort and group mail into smaller batches. Sorting modules 54L, 54S, 54DS, 54DE of each type are described in greater detail in commonly-owned, co-pending U.S. patent application Ser. No. 11/856,174 entitled "Macro Sorting System and Method", filed on 7 Apr. 2006 and Ser. No. 11/856,299 entitled "Mail Sorter for Simultaneous Sorting Using Multiple Algorithms" filed on 7 Apr. 2006 and are herein incorporated by reference in their entirety.

Inbound Mail Sorting Bank—Upper Tier

Upon ingestion, i.e., receipt and processing within one of the input stations 12, the system controller 50 processes the mailpiece information to direct the sorting of mail into groups of inbound and outbound mail. The processor 50 directs the EBS system 20 to store inbound mail into a first sorting bank 20A and store outbound mail into a second sorting bank 20B. The inbound mail is elevated upwardly to one of the uppermost tiers 58U and stored in large batch storage modules 54L during the first phase of sorting operations. In the context used herein, the uppermost tiers 58U include all tiers disposed upwardly from the second tier, i.e., tier three (3) and up.

Figure 4A:
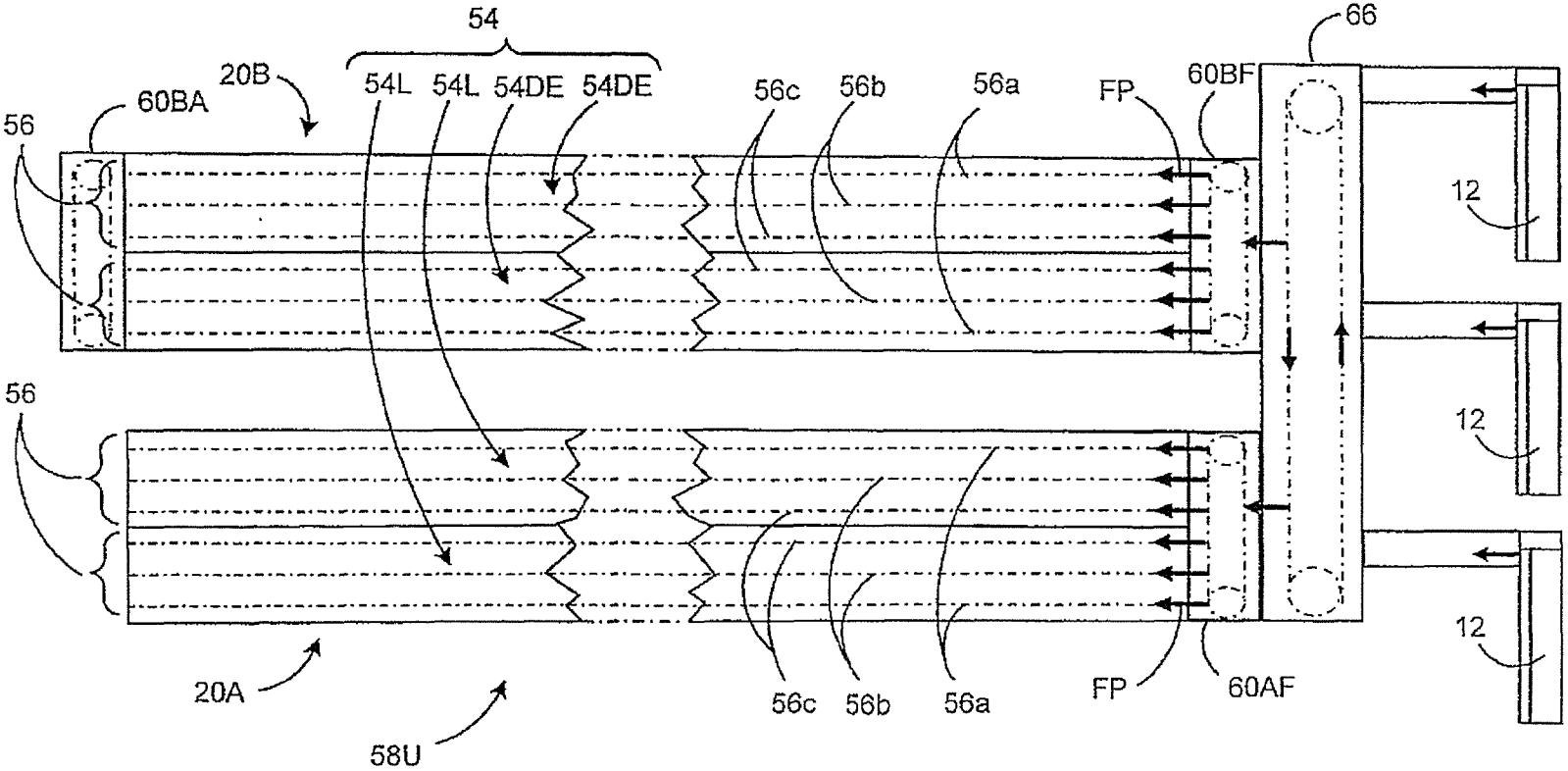
FIG. 4*a* is a segmented schematic view taken through section line 4*a* of FIG. 2 depicting an upper tier of the EBS sorting system.

In FIGS. 2 and 4*a*, a schematic top sectional view of the inbound and outbound sorting banks 20A, 20B along the upper tiers 58U is shown. The following discussion will first describe the sorting, storage and flow of mail within the sorting bank 20A dedicated to processing inbound mail. Thereafter, the sorting, storage and flow of mail within the sorting bank 20B for outbound mail will be described.

Continuing with our discussion of inbound mail, each large batch sorting module 54L includes three (3) conveyance paths/storage areas 56*a*, 56*b*, 56*c* wherein each path is dedicated to storing inbound mail in large batches. Inasmuch as the sorting bank 20A comprises (2) two rows 56 of sorting modules 54L, the upper tiers each having a total of six (6) storage areas 56*a*, 56*b*, 56*c*. Each of the conveyance paths/storage areas 56*a*, 56*b*, 56*c* is capable of moving mail linearly along its length in either direction, i.e., either toward or away from the elevator 60AF. Furthermore, each of the conveyance paths/storage areas 56*a*, 56*b*, 56*c* is capable of incrementally accepting mail, one at a time, to store large batches of mail, i.e., mail having a common attribute. As mail is elevated to each of the uppermost tiers 58U, each mailpiece is transferred to a select one of the conveyance paths/storage areas 56*a*, 56*b*, 56*c* (due to the ability of an elevator 60AF to distribute mail to any one of the conveyance paths/storage areas 56*a*, 56*b*, 56*c*). Each of the conveyance paths/storage areas 56*a*, 56*b*, 56*c* is incremented to provide an available space/slot for the next mailpiece. As such, each large batch of mail builds in the direction of input arrows FP from an inboard end, i.e., proximal to the elevator 60AF, to an outboard end, i.e., distal from the elevator 60AF.

In the described embodiment, each of the paths/storage areas 56*a*, 56*b*, 56*c* has a capacity corresponding to the requirements of a single large batch of mail which may, for example, be the equivalent or one delivery route, having approximately six-hundred (600) address destinations and a total of about three-thousand (3000) mailpieces. Although, each of the paths 56*a*, 56*b*, 56*c* may be larger or smaller depending upon the space available within the distribution center. For example, if a particular high-density route has twelve-hundred (1200) address destinations, then two (2) paths/storage areas 56*a*, 56*b* may be assigned/dedicated to store mail associated with the high-density route. On the other hand, if several low-density routes each have two-hundred (200) address destinations, then a single path/storage area 56*c* may be employed to accept mail from multiple low-density routes. While the mail associated with these routes will necessarily be intermixed along the path/storage area 56*c*, the mail for each route will be culled/sorted/grouped during the second phase of sorting operations, i.e., when the mail is sorted to small batches and to delivery sequence. As used herein, the term "batch" means a plurality of specified addresses.

After all of the inbound mail has been received and sorted into large batch storage areas 56*a*, 56*b*, 56*c*, the second phase of sorting operations begins. During the second phase, the system controller 50 utilizes a dispatch schedule to determine which of the large batches of mail will be unloaded first, second, third and so on, such that the mail will reach its final destination, i.e., another sorting/distribution center, a local delivery office, or post office, on or before the scheduled arrival time.

Sorting Bank—Inbound Mail in Lower Tier

Figure 4B:
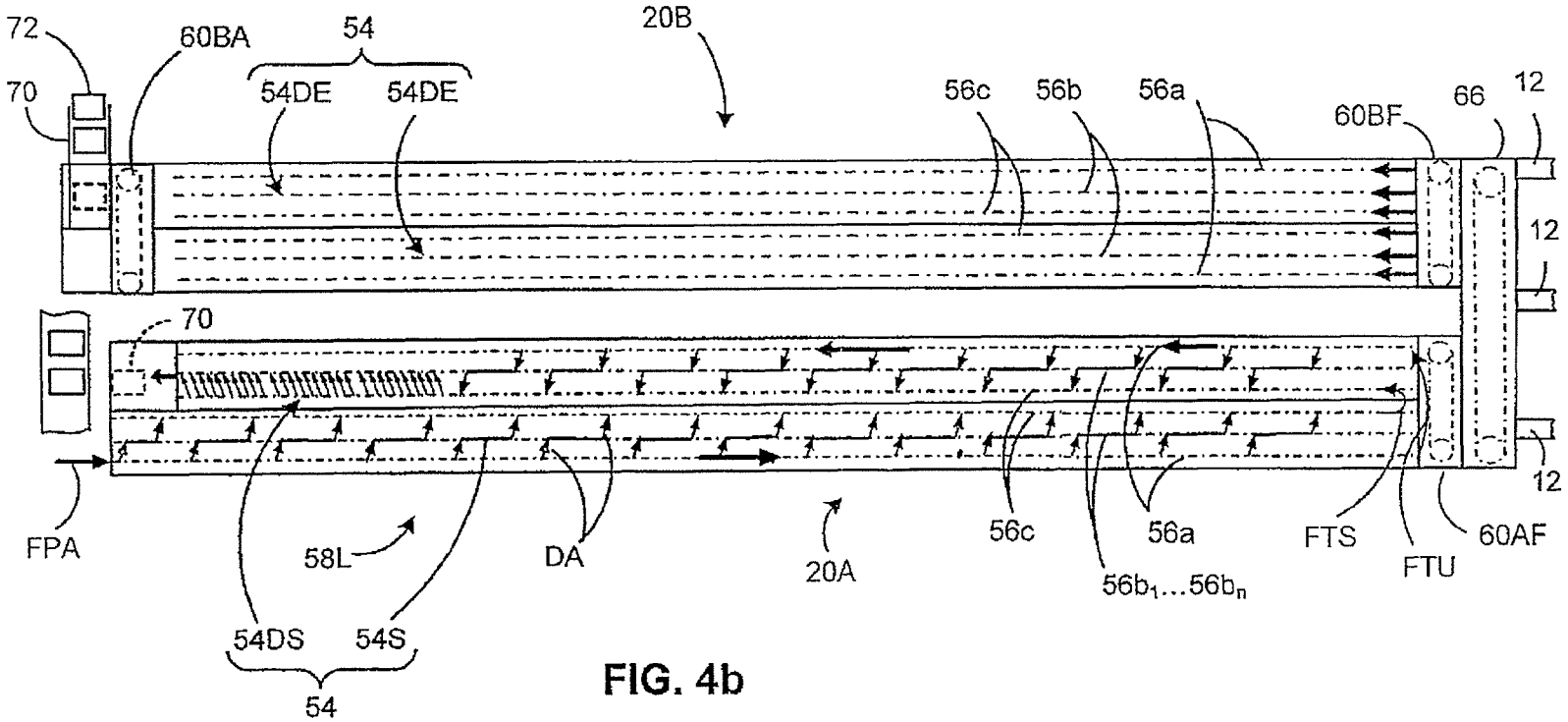
FIG. 4*b* is a schematic view taken through section line 4*b* of FIG. 2 depicting a lower tier of the EBS sorting system.
Figure 4C:
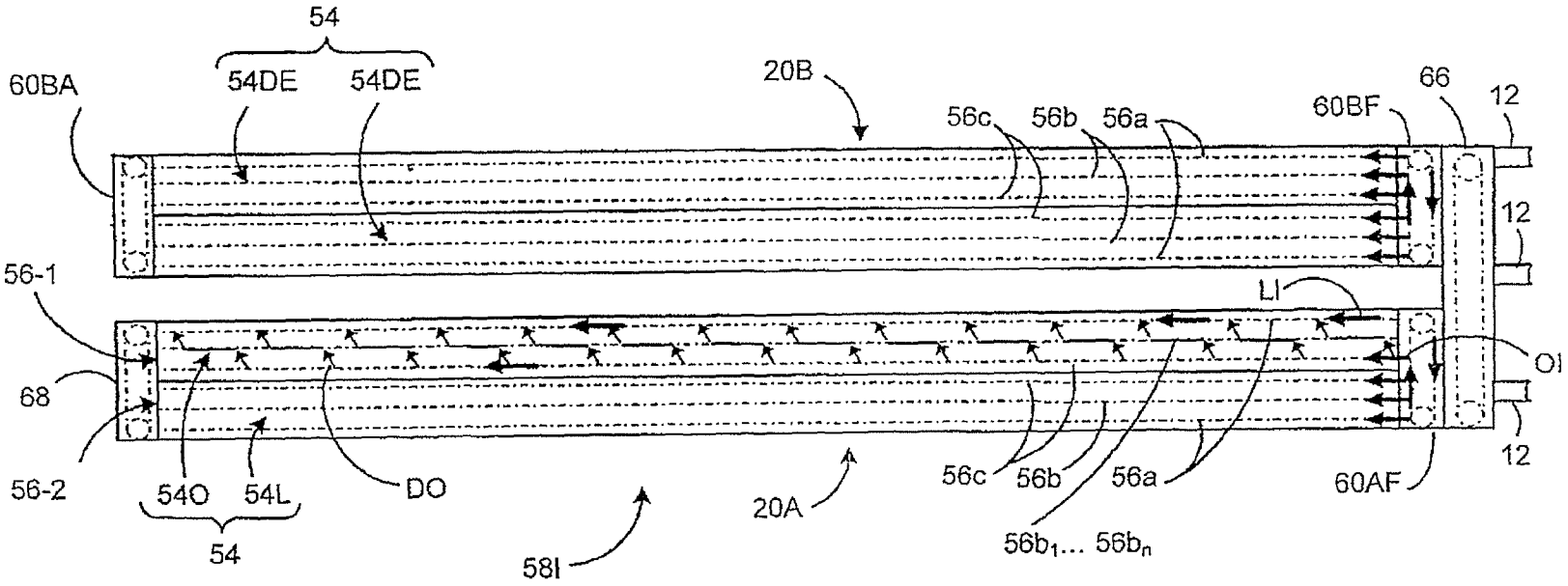
FIG. 4*c* is a schematic view taken through section line 4*c* of FIG. 2 depicting an intermediate tier, between the upper and lower tiers, of the EBS sorting system.

In the second phase or during dispatch, the system controller 50 directs the transfer of mailpieces, previously sorted to large batches in the upper tiers 58U, to the lowermost tier 58L. Referring to FIGS. 2, 4*b* and 4*c*, mail is initially conveyed to the forward elevator 60AF and descends to an intermediate tier 58I (see FIGS. 2 and 4*c*) immediately above the lowermost tier 58L. The large batch of mail traverses the full length of the intermediate tier 58I along an outermost conveyance path 56*c* and, subsequently, moves to the lowermost tier 58L via a single tier elevator 68, i.e., an elevator which lowers mail from the intermediate tier 581 to the lowermost tier 58L. Finally, the large batch of mail traverses the outermost conveyance path 56*a* (see FIG. 4*b*) toward each of the sort-to-small batch modules 54S and small batch storage areas 56*bi* . . . 56$b_n$. By traveling this path 56*c*, each large batch of mail enters the lowermost tier 58L at a point (shown as an arrow FPA in FIG. 4*b*) which maximizes the available number of small batch modules 54S and small batch storage areas 56*bi* . . . 56$b_n$. Furthermore, overflow mail (discussed in greater detail below when discussing several space optimization techniques), may be stored in the intermediate tier 58I (FIG. 4*c*) and appended to large batches which have exceeded the storage capacity above, i.e., in an upper tier of the sorting bank 20A.

As mail traverses the outermost conveyance path 56*a*, it is selectively transferred and sorted via diverter units (shown only as arrows DA in FIG. 4*b*) to the small batch storage areas 56*bi* . . . 56$b_n$ disposed between the outermost path 56*a* and an innermost path 56*c*. In the described embodiment, twenty-four (24) small batch storage areas 56*bi* . . . 56$b_n$ are depicted, though a greater or fewer number of small batch storage areas 56*bi* . . . 56$b_n$ may be employed depending upon the size and density of the large batches above. While remaining in the same sequence/order, the mail is finally transferred to the innermost path 56*c* for subsequent conveyance to the sort-to-delivery sequence modules 54DS. Large, unsorted batches of mail are taken from the outermost path 56*a* of one row 56-2 via turn path FTU to the outermost path 56*a* of the other row 56-1. After being sorted/stored in each small batch storage area 56*bi* . . . 56$b_n$, the mail is transferred to the innermost path 56*c* of one row 56-2 and transferred to the innermost path 56*c* of the other row 56-1 along the inner turn path FTS. Once transferred to the innermost path 56*c*, the mail advances to the sort-to-delivery sequence modules 54DS.

While the present invention includes an intermediate step of sorting mailpieces to small batches, it should be appreciated that the EBS system 20 may be configured to sort mail directly from large batches in the uppermost tier 58U to delivery sequence in the lowermost tier 58L. A disadvantage, however, of directly sorting the mail to delivery sequence relates to the relatively large number of mailpiece diverter/transfer units which are then required. For example, to directly sort six-hundred (600) address destinations to delivery sequence, an equal number of diverter/transfer units, i.e., six-hundred (600) units, are required. However, for the purposes of this discussion, it should be appreciated that such diverter/transfer units are: (i) costly to produce and assemble, (ii) highly complex, i.e., both mechanically and functionally, (iii) require skilled operators for installation and maintenance, (iv) consume valuable real estate/internal space within the sorting banks and (v) are critical components in terms of the overall reliability of the EBS system 20. With respect to the latter, the probability for mis-feeds, jams and other system failures may be greatest at the interface between the adjacent paths 56*a*, 56*c* and storage areas 56*b*-1 . . . 56$b_n$. Consequently, it is reasonable to conclude that the reliability of the EBS system 20 may decrease as the number of diverter/transfer units increase. A detailed description of a diverter/transfer unit and the escort device therefor is provided following our discussion of the sorting banks 20A, 20B.

Finally, the system controller 50 transfers mailpieces, to the sorting modules 54DS to sort the mail to delivery sequence. In the described embodiment, only three (3) delivery sequence modules 54DS are shown, although the EBS system 20 may incorporate a greater or fewer number of sorting modules 54DS depending upon the maximum number of mailpieces which can be stored in each of the small batch storage areas 56*b*-1 . . . 56$b_n$. A final output station conveyor 70 (see FIGS. 2 and 4*b*), unloads the mail, which has now been sorted to delivery sequence, removes it from the escort device places it into trays 72 (either manually or automatically). In one embodiment, clamps and associated mailpieces are lowered into a tray or container having a slot therein for enabling each clamp to pass while causing the sidewalls of the tray/container to retain the mailpiece. That is, each mailpiece is removed from the jaws of the respective clamp, as the clamp is drawn away from the tray/container.

From this lowermost tier 58L, the time required to unload and dispatch the mail, i.e., sorted to delivery sequence, is minimized. A tray unloading system of the type described above may be found in commonly-owned, co-pending U.S. Publication No. 2006/441,988 entitled "Method for Optimally Loading Objects into Storage/Transport Containers" filed 26 May 2006 which is hereby incorporated by reference in its entirety.

Sorting Bank—Outbound Mail

In FIGS. 4*a*-4*c*, each sorting bank 20B dedicated to outbound mail includes a plurality of sort-to-destination modules 54DE. Each sort-to-destination module 54DE includes a plurality of outbound storage areas 56*a*, 56*b*, 56*c* which are structurally and functionally similar to the large batch storage areas 54 associated with the sorting bank dedicated to inbound mail. That is, similar to the large batch storage areas 54L, each outbound storage area includes a plurality of conveyance paths 56*a*, 56*b*, 56*c* which function to receive and store outbound mail.

While the various tiers 58L, 58I and 58U of an inbound sorting bank 20A may include a variety of modules 54L, 54S, 54DS, a sorting bank 20B dedicated to the receipt, storage and dispatch of outbound mail will generally be comprised of sort-to-destination modules 54DE having a plurality of storage areas/paths 56*a*, 56*b*, 56*c*. That is, each tier of an outbound sorting bank 20B will be essentially identical and not include diverter/transfer units such as those needed to sort inbound mail to small batches or to delivery sequence.

Inasmuch as outbound mail may be dispatched at any time during the first or second phases of sorting operations, the outbound sorting bank 20B may also include an aft elevator 60BA, i.e., an elevator to enable mail to descend from any of the upper tiers. As such, outbound mail may continue to be sorted and stored, i.e., distributed and raised to the appropriate tier, by the forward elevator 60BF, while, at the same time, being dispatched via an aft elevator 60BA.

Space Optimization—Overflow Mail/Outbound Mail in an Intermediate Tier

Referring once again to FIGS. 2, 4*a*-4*c*, the EBS system 20 is adapted to optimize the use of space within each of the sorting banks 20A, 20B. More specifically, the system controller/processor 50 may be operative to (i) dynamically allocate, i.e., the number of addresses to be sorted, to each small batch storage area 56*bi* . . . 56*b* (see FIG. 4*b*) to minimize occurrences of open or underutilized space within the sorting modules 54S, (ii) assign additional space for large batches of mail within overflow storage modules 540 to function in an overflow storage capacity, and (iii) utilize the small batch storage areas of the inbound sorting banks 20A to sort/store select outbound mail during the first phase of sorting operations. Inasmuch as the EBS system 20 has captured information on each ingested mailpiece associated with a particular route, the system controller 50 may determine the actual number of the mailpieces associated with each address destination. With this data, the system controller 50 acquires/gathers information on the number of spaces required for each address destination within each small batch storage area. The space requirement/allocation is based upon the number of mailpieces being delivered to a particular address and the thickness of each. With respect to the latter, a catalog or newspaper, for example, may be assigned two or three spaces based upon its thickness which may be three times larger than a thin letter envelope.

Furthermore, the system controller 50 determines the number of spaces required for each address destination, and adds them together until an integer number of address destinations nearly fill each small batch storage area 56*bi* . . . 56$b_n$. For example, as a small batch storage area 56*bi* . . . 56$b_n$ nears full capacity, e.g., has six (6) remaining spaces available for the receipt of mailpieces, an address destination which requires eight (8) spaces will be assigned to the next available small batch storage area. As a result, only a small number of spaces within each small batch storage area will remain empty and, consequently, the space within the sorting bank 20A can be optimized. Moreover, by allowing a variable number of destination addresses to be stored in each small batch storage area 56*bi* . . . 56$b_n$, a smaller number of sort-to-small batch modules 54S will be required. Alternatively, the storage capacity of each small batch module 54S may be reduced to handle daily variations in mail volume.

To further optimize the utilization of space within each inbound sorting bank 20A, the EBS system 20 accommodates sufficient storage in each of the large batch storage areas, i.e., in the sort-to-large batch modules 54L of the uppermost tiers 58U, to process a daily average of mailpieces (in addition to a small amount of extra space). That is, the EBS system 20 is designed to provide sufficient storage in the large batch storage areas without accommodating all possible variations in daily mail volume. For example, there will be occasions when the designated storage capacity is exceeded for one or more large batch storage areas by unusually high mail volume. In FIG. 4*c*, the system controller 50 accommodates these occasions by assigning one or more overflow storage areas 540 in an intermediate tier 58I of the sorting bank 20A when the actual number of mailpieces 22 ingested exceeds the capacity for mailpieces 22 stored in a large batch storage area of the upper tier 58LJ.

More specifically, the intermediate tier 581 includes a plurality of overflow storage modules 540 having overflow storage areas 56*bi* . . . 56$b_n$ which are allocated by the system controller 50. These areas 56*bi* . . . 56$b_n$ may each be used to store an overflow of mail associated with one or more of the large batches of mail above. On high volume mail days, i.e., when the number of mailpieces associated with a particular route exceeds the capacity of one of the large batch storage areas 56*a*, 56*b*, 56*c*, the system controller 50 is adapted to assign one or more overflow storage areas 56*bi* . . . 56$b_n$ for receiving the overflow of mail in connection with a specific large batch. Rather than being stored in a large batch storage area above, the overflow mail is diverted from the elevator 60AF at the intermediate tier 58I (entering the tier 58I at along arrow O1) and travels along an innermost conveyance path 56*a* thereof (see FIG. 4*c*) until reaching an assigned overflow storage module 540. The mail is then diverted, along arrows DO and accumulates in the overflow storage areas 56*bi* . . . 56$b_n$ (disposed between the innermost path 56*a* and an outermost path 56*c*).

In the described embodiment, fifteen (15) tandemly arranged overflow storage modules 54O are shown, each having a capacity to store about three hundred (300) mailpieces. Additionally, only one row 56-*i* of the sorting bank 20A includes overflow storage modules 540 while the adjacent row 56-2 may be assigned to store large batches of mail, i.e., in large batch storage modules 54L along the storage areas 56*a*, 56*b*, 56*c*.

In yet another embodiment of the invention, the space resources may be further optimized by utilizing the lowermost tier 58L of the sorting bank 20A, i.e., the bank principally dedicated to storing/sorting inbound mail during the second phase of sorting operations, to function as a storage area for outbound mail during the first phase of sorting operations. Certain outbound destinations, e.g., a small city in Montana, USA, may typically have a small volume of mail to be dispatched at a time, e.g., 9:00 pm, each day before the second phase of sorting operations begins, e.g., 3:00 am. Inasmuch as a sort-to-small batch module 54S of the lowermost tier 58L may have capacity to store the outbound mail, i.e., the mail destined for Montana, the system controller 50 may be adapted/programmed to sort/store such small batches of outbound mail in this module 54S. Similarly, a sort-to-delivery sequence module of the lowermost tier 58L may also be used in this capacity. It should be borne in mind, however, that large batches of outbound mail are simultaneously stored in the sorting bank 20B dedicated to outbound mail.

When dispatching a large batch of inbound mail 22 i.e., after the completion of phase one sorting operations, the system controller 50 moves mail from a large batch storage area above to an intermediate tier 581 via a spiral elevator 60AF (entering along an arrow F1). The mail 22 is conveyed along the outermost path 56*c* and passes the overflow mail 22 stored in one of the overflow storage areas 56*bi* 56$b_n$. When the last mailpiece 22 passes the assigned one of the overflow areas 56*bi* . . . 56$b_n$, the overflow mail 22 is diverted and appended to an end of the large batch before being transferred to a lowermost tier 58L. The large batch from the upper tier 54U is joined with the overflow mail from the intermediate tier to form a single large batch for sorting into small batches, i.e., in the lowermost tier. As a result, the EBS system 20 may assign the use of an underutilized area, i.e., in an intermediate tier 58I, rather than oversize each large batch storage area to handle maximum mail volume days.

While the inbound mail 22 loaded, stored and sorted in the first sorting bank 20A is dispatched only during the second phase of sorting operations, outbound mail which has been loaded, stored and sorted in the second sorting bank 20B may be dispatched at any time during the first or second phase depending upon the dispatch schedule. To avoid interference with mail 22 being continuously fed to either of the sorting banks 20A, 20B, the sorting bank 20B dedicated to outbound mail may include forward and aft elevators 60BF, 60BA at each end of the sorting bank 20B such that outbound mail 22 may be dispatched via the aft elevator 60BA. Additional mail, both inbound and outbound may continue to be loaded using the forward elevators 60AF, 60BF.

Multi-Path Conveyance/Diverter System

The conveyance paths and storage areas 56*a*, 56*b*, 56*bi* . . . 56$_b n$, 56*c* of the various modules 54L, 54DE, 54S, 54DS, and 540 are produced by a conveyance/diverter system which accepts, directs, stores and dispatches a plurality of escort devices 26, each carrying an individual mailpiece 22. Furthermore, the conveyance/diverter system enables conveyance and transfer across multiple paths which are substantially parallel and/or adjacent. As previously mentioned, at least (2) two of the modules, i.e., the sort-to-large batch and sort-to-destination modules 54L, 54DE (see FIG. 4*c*), comprise three (3) adjacent paths 56*a*, 56*b*, 56*c* for storing and conveying escorted mailpieces 22. Hence, no diverter units are required for moving/diverting mail from one path to an adjacent path. On the other hand, several modules, e.g., the sort-to-small batch, sort-to-delivery sequence and overflow modules, 54S, 54DS, 54O, employ multiple paths 56*a*, 56$_b i$ . . . 56$_b n$, 56*c*, i.e., several paths, which divert, and store and convey escorted mailpieces 22. The discussion will initially emphasize and describe the conveyance paths commonly used to convey and/or store escorted mailpieces and subsequently describe diverter/transfer units, storage areas/paths and the unique features of the escort device which enable transfer across multiple paths. The various elements of the conveyor/diverter system will be discussed in greater detail below.

Figure 5:
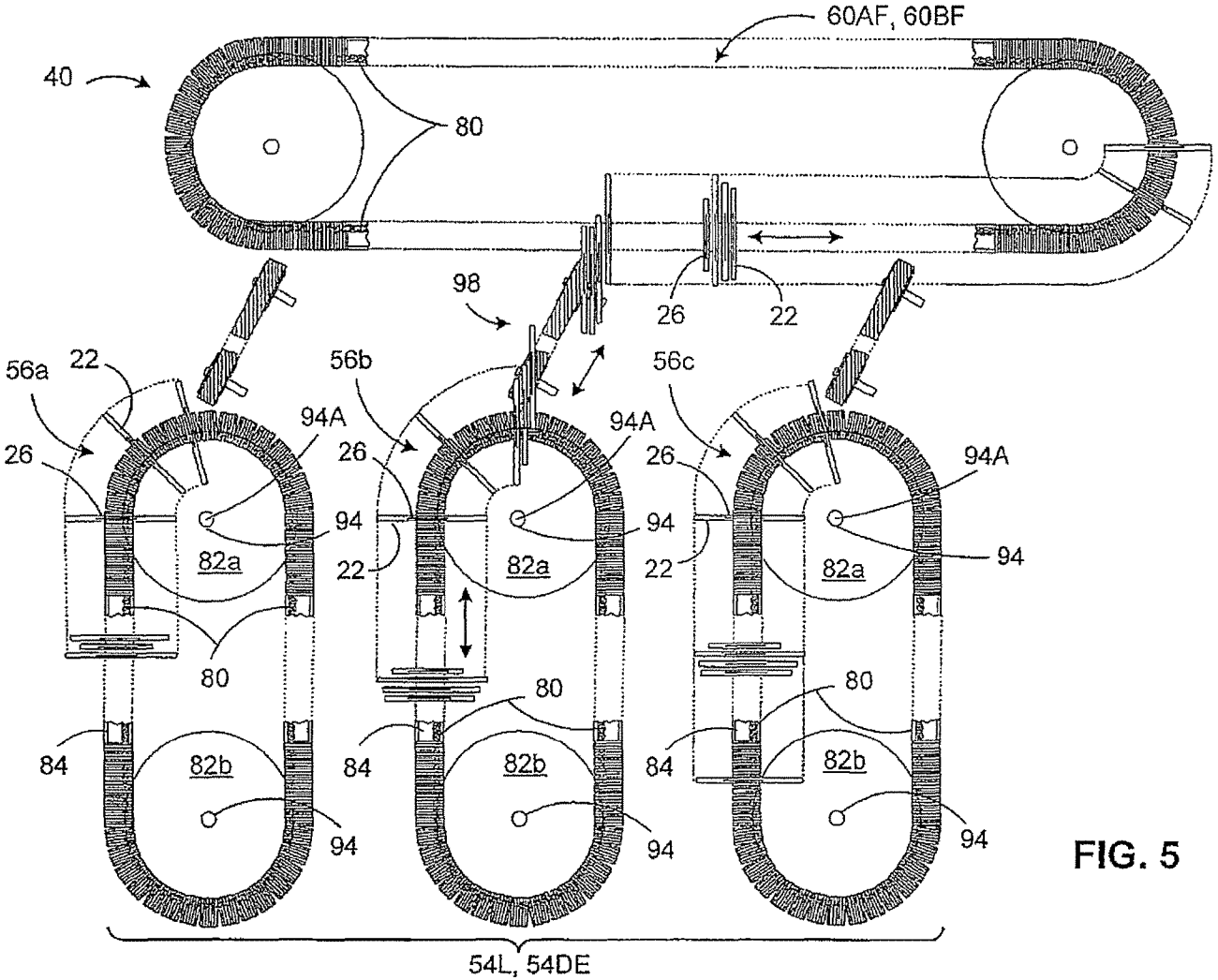
FIG. 5 is a segmented top view of a multi-path conveyance/diverter system according to one embodiment of the invention including a plurality of conveyance paths for storing and conveying mailpieces along a length of each path.
Figure 8:
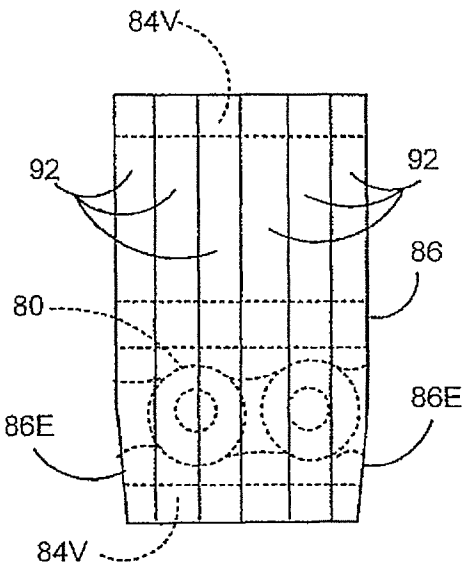
FIG. 8 is an enlarged top view of a single drive element.
Figure 7:
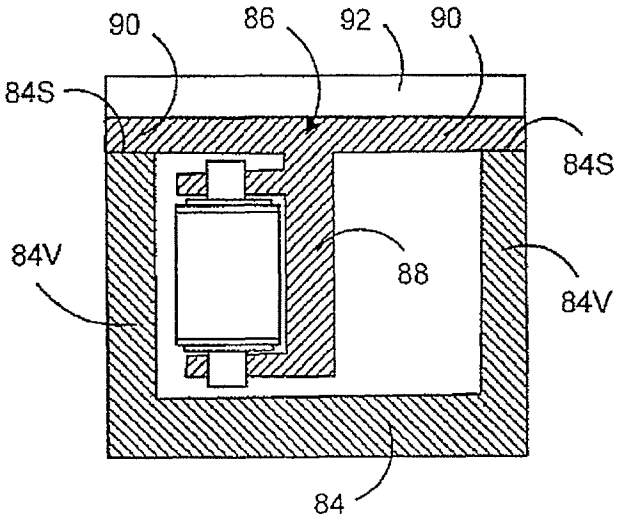
FIG. 7 is a sectional view taken along line 7-7 of FIG. 6 depicting a drive element driven by a chain drive assembly.
Figure 6:
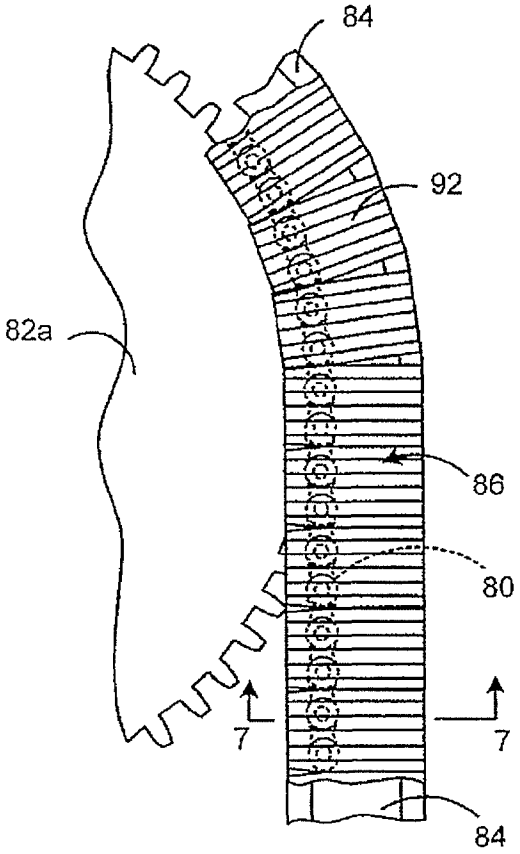
FIG. 6 is an enlarged broken away top view of a chain drive assembly for conveying escorted mailpieces.

In FIGS. 5 through 8, a conveyor/diverter system 40 according to the present invention may include a chain drive assembly comprising a chain 80 (see FIGS. 5 and 6) driven in a continuous loop around a pair of conventional sprockets 82*a*, 82*b*. The chain 80 and sprockets 82*a*, 82*b* generally extend the length of the modules 54L, 54DE and lie in a substantially horizontal plane. In the described embodiment, the sprockets 82*a*, 82*b* are driven and supported by a vertical shaft (not shown) while the chain 80 slides within and is supported by a U or C-shaped channel 84 (best seen in FIG. 7). The channel 84 augments the bending stiffness of the chain 80 (to react shear and moment loads imposed by the weight of the escorted mailpieces 22) and may be continuous, i.e., extending the full length of the chain 80 or may be segmented, i.e., supporting the chain 80 at various intermediate positions. In FIG. 6, the channel may transition to a C-shape from a U-shape as the chain 80 extends around and engages each of the sprockets 82*a*, 82*b*.

The chain 80 is affixed to and drives a plurality of drive elements 86. In the described embodiment, each drive element 86 includes a central web 88 and flanges 90 projecting laterally to each side of the web 88. The central web 88 extends into the U-shaped channel 84 and is driven by the chain 80 while the flanges 90 extend over and are supported by the vertical walls 84V of the channel 84. As depicted, the flanges 90 are in sliding engagement with the elongate edge surfaces 84*s* of the channel 84, though any bearing means may be employed to facilitate relative movement therebetween while supporting the respective drive element 86.

The drive elements 86 are closely-spaced, tandemly-arranged and may have crowned edges 86E to facilitate travel around a circular path, i.e., the arcuate periphery of the end sprockets 82*a*, 82*b*. Furthermore, each of the drive elements 86 comprise a plurality of transverse grooves 92 adapted to accept, drive and support the escort devices 24. More specifically, the grooves 92 are substantially linear and are either oriented (i) transversely of the conveyance path or (ii) parallel with respect to a face surface of an underlying mailpiece 22. In the described embodiment, each drive element 86 includes approximately three (3) to five (5) transverse grooves 92 for supporting an equal number of escorted mailpieces 22. Though, at times, one or more grooves 92 may not be used, i.e., remain empty to provide additional clearance for thick mailpieces.

With respect to the large batch storage areas/paths 56*a*, 56*b*, 56*c* located in the upper tiers 58U of an inbound sorting bank 20A and the destination storage areas/paths 56*a*, 56*b*, 56*c* associated with all tiers 58 of an outbound sorting bank 20B, escorted mailpieces 22 are received or dispatched from one of the forward elevators 60AF, 60BF and a respective one of the storage areas/paths 56*a*, 56*b*, 56*c*. Generally, as each conveyance element 86 traverses one of the circular sprockets 82*a*, 82*b*, each of the transverse grooves 92 assumes a radial orientation relative to the rotational axis 94A (see FIG. 5) of the sprocket shaft 94. More specifically, the drive elements 86 produce a "fanning" effect as they traverse the circular sprockets 82*a*, 82*b* to facilitate loading and dispatch. Moreover, the escorted mailpieces 22 are generally accumulated/stored on one side of the chain drive assembly 80, 82*a*, 82*b* and, upon dispatch may be conveyed in either direction. FIG. 5 shows escorted mailpieces being loaded dispatched from the intermediate storage path 56*b*, across a diverter unit 98 to an elevator assembly 60AF, 60BF.

As mentioned earlier, mail 22 sorted in large batch storage areas of an inbound sorting bank 20A may travel in one direction during sorting operations and in an opposite direction, for return to a forward elevator 60AF, i.e., during dispatch. Mail 22 sorted in destination storage areas 56*a*, 56*b*, 56*c* of an outbound sorting bank 20B may travel in one direction during sorting operations, and in the same direction, toward an aft elevator 60BA for continuous loading and dispatch of outbound mail.

Figure 9:
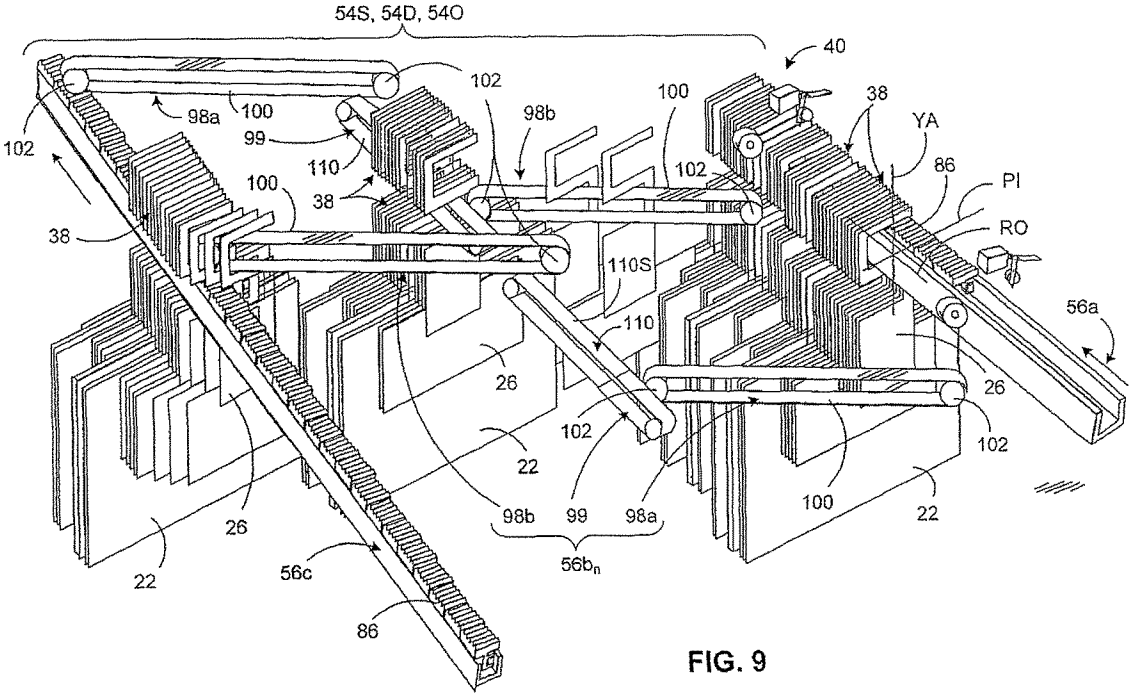
FIG. 9 is a partially broken-away perspective view of the multi-path conveyance/diverter system shown in FIG. 8 for illustrating the interaction of an inventive mounting fixture/escort device for use in combination with the multi-path conveyance/diverter system.
Figure 10A:
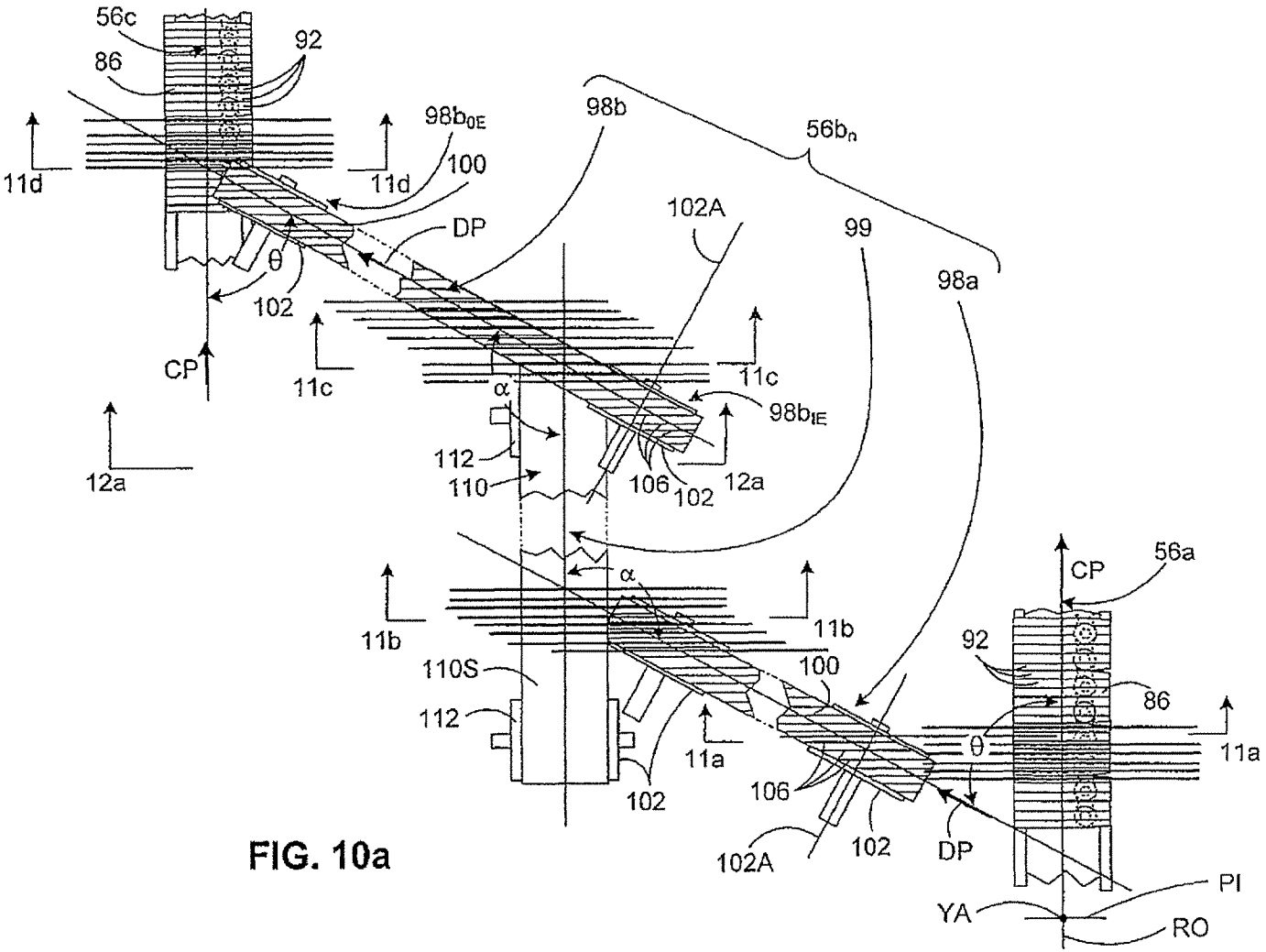
FIG. 10*a* is a segmented, broken-away, top view of a multi-path conveyance/diverter system according to another embodiment of the invention including a central conveyance/storage path for transferring escorted mailpieces mail across the paths.

In FIGS. 9 and 10*a*, another embodiment of the inventive conveyor/diverter system 40 illustrates the structural and functional details associated with each sort-to-small batch module 54S, sort-to-delivery sequence module 54DS and overflow module 540. FIG. 9 is a perspective view of two (2) central conveyance/storage paths $\mathbf{56}b_n$ disposed between the outer and innermost conveyance paths 56*a*, 56*c*. As such, this storage area/path $\mathbf{56}b_n$ is equivalent to a third or central connecting path of the inventive multi-path conveyance/diverter system 40. As will be discussed in greater detail below, the central conveyance/storage path $\mathbf{56}b_n$ is any path disposed between the outer and innermost paths 56*a*, 56*c* which diverts escorted mailpieces 22 from one path to another and stores select escorted mailpieces 22 therebetween. Hence, the central conveyance/storage paths $\mathbf{56}b_n$ may include one or more conveyance elements defining one or more paths.

In the described embodiment, the central conveyance/storage path 56*b*, includes a pair of diverter units 98*a*, 98*b* and an accumulator 99 disposed therebetween. The pair of diverter units 98*a*, 98*b* transfer escorted mailpieces 22 across the various conveyance/storage paths 56*a*, $\mathbf{56}b_{nA}$, 56*c*. More specifically, each of the diverter units 98*a*, 98*b* is disposed in a substantially vertical plane between each of the outer and innermost conveyance paths 56*a*, 56*c* and the central accumulator 99. Furthermore, each of the diverter units 98*a*, 98*b* includes a flexible belt 100 disposed over a pair of pulleys 102, i.e., a drive pulley and an idler pulley. Moreover, each of the diverter units 98*a*, 98*b* defines a diverter path DP (see FIG. 10*a*) which forms an acute angle θ relative to the direction of motion CP along each of the outer and innermost conveyance paths 56*a*, 56*c*. Furthermore, the diverter path DP defines an obtuse angle α relative to the direction of motion along the accumulator 99.

Additionally, each of the flexible belts 100 includes a plurality of linear grooves 106 which are "off-axis" relative to the rotational axis 102A of each of the pulleys 102. Furthermore, when installed and operating, each of the linear grooves 106 is parallel to, synchronized with, and travels at the same forward velocity as the transverse grooves 92 of each of the inner and outermost conveyance paths 56*a*, 56*c*. That is, the linear grooves 106 have a component of velocity that equals the velocity of the transverse grooves 92. More specifically, the drive pulley 102 of each of the diverter units 98*a*, 98*b* drives each flexible belt 100 to effect a resultant velocity (i.e., along the length of each belt 100) having a component of velocity (i.e., parallel to the linear motion of each of the outer and innermost conveyance paths 56*a*, 56*c*) which is equal to the forward velocity of the drive elements 86 and transverse grooves 92. As will be seen when discussing the operation of each of the diverter units 98*a*, 98*b*, these kinematic and geometric relationships, mitigate moment loads tending to pivot/rotate the escorted mailpiece 22 about the various pitch, roll and yaw axes, P1, RO, VA, respectively (see FIG. 9).

Similar to the diverter units 98*a*, 98*b*, the accumulator 99 includes an accumulator belt 110 disposed around a pair of pulleys 112, i.e., a drive pulley and an idler pulley. The accumulator belt 110 and pulleys 112 lie in a substantially vertical plane and are substantially parallel to the outer and innermost conveyance paths 56*a*, 56*c*. The accumulator belt 110 may also be supported along its length via a stiffener (not shown) to react the weight of escorted mailpieces 22 which are sorted and stored on the exterior surface 110S of the belt 110, in the described embodiment, the exterior surface 1000S is planar, through the surface may define a plurality of grooves (not shown) for accepting and conveying escorted mailpieces 22.

Escort Device

While the escort device 26 has been described and illustrated as including a clamp having a pair of spring-biased jaws 32*a*, 32*b* (shown in FIG. 3) to secure a mailpiece, in the broadest sense, the escort device 26 may include any means for securing the mailpiece. Furthermore, the mounting fixture 38 is attached to the opposing elements e.g., the jaws 32*a*, 32*b*, and is operative to suspend the mailpiece 22 from the conveyance/diverter system 40. More specifically, and referring to FIGS. 10*a* and 11 *a*, the mounting fixture 38 of each escort device 26 includes at least two separate and distinct load bearing surfaces 120, 122. In the context used herein, the term "load bearing surface" means the portion of the mounting fixture 38 across which loads are transferred and may define a linear edge or small area as thin/thick as the material used in the fabrication of the fixture 38. In terms a broad functional and/or structural definition, the load bearing surfaces 120, 122 (*i*) are adapted to transfer static loads imposed by the weight of the mailpiece 22 to the conveyance/diverter system 40, (ii) are vertically spaced to facilitate access by adjacent paths/element of the conveyance/diverter system 40, and (iii) intersect a vertical line VCG passing through the Center of Gravity (CG.) or centroid 36 (see FIG. 3) of the escorted mailpiece 22.

To accommodate transfer across several paths e.g., three paths, the mounting fixture 38 preferably defines a substantially square-S shape. However, it should also be appreciated that the mounting fixture 38 may define other shapes depending upon the number of conveyance paths which may be crossed. For example, an F, E or square-C shaped mounting fixture may be employed when a greater or fewer number of conveyance paths are crossed.

Figure 11B:
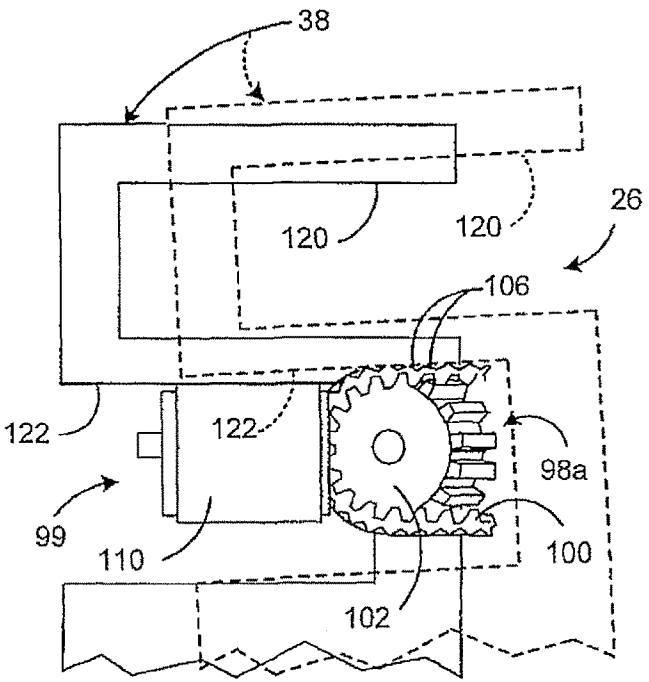
Figure 11A:
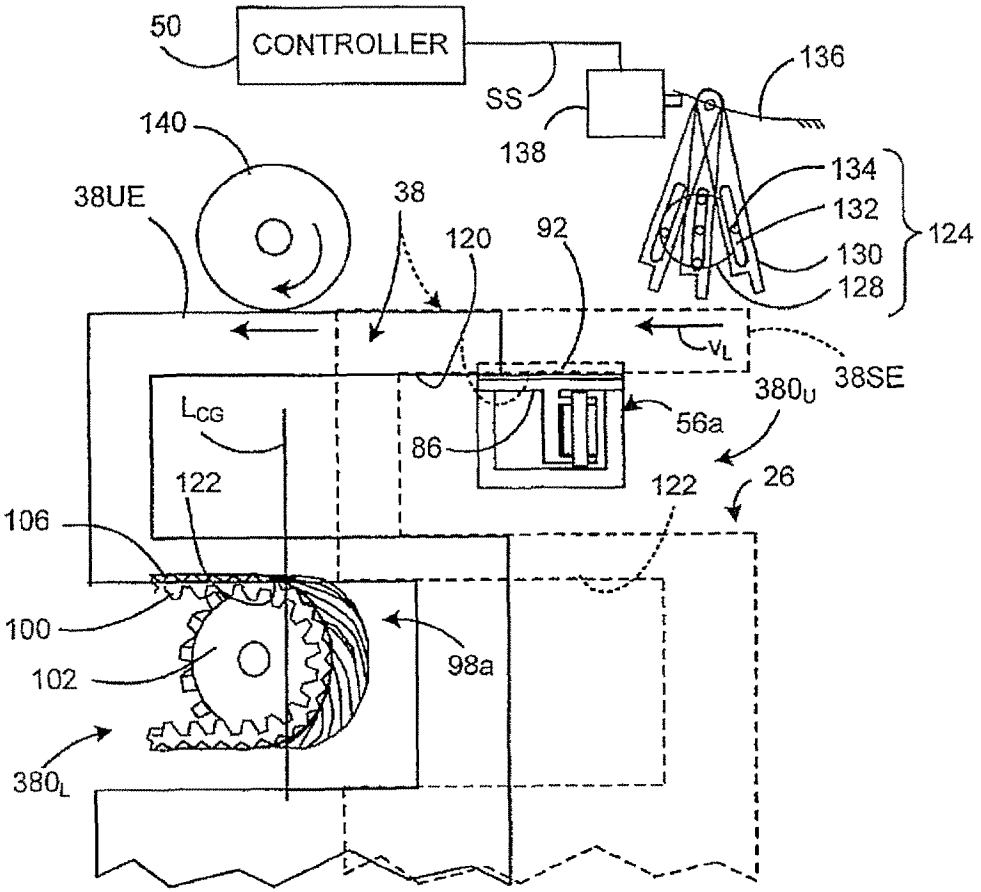

FIG. 11*a* depicts the transfer of an escorted mailpiece 22 from the outermost conveyance path 56*a* to a first diverter unit 98*a* of the conveyance/diverter system 40. The mailpiece and jaws of the escort device 26 have been broken-away, i.e., omitted, to emphasize the motion/transfer of the mounting fixture 38 across the conveyance and diverter paths of the conveyance/diverter system 40. The mounting fixture 38 is shown in dashed lines when engaging the outermost conveyance path 56*a* and in solid lines when engaged with the first diverter unit 98*a* of the conveyance/diverter system 40. Depending upon the direction of movement, open ends 38Oj, 38OL of the square-S shaped mounting fixture 38 are adapted to face one of the outer or innermost conveyance paths 56*a*, 56*c*, i.e., taken or viewed from a position between the paths 56*a*, 56*c*. This arrangement enables the mounting fixture 38 to engage the chain drive assembly during transport/storage and facilitates the disengagement of the load bearing surfaces 120, 122 as the mounting fixture 38 either moves away or toward one of the paths 56*a*, 56*c*. In FIG. 11*a*, the open upper end 38Ou of the mounting fixture 38 faces or opposes the outermost conveyance path 56*a*.

The various conveyance paths 56*a*, 56*c* may be vertically elevated or lowered relative to an adjacent one of the diverter units 98*a*, 98*b* for the purpose of transferring the escorted mailpiece 22 across the multi-path conveyance/diverter system 40. That is, to facilitate movement from one of the drive elements 86 of the outermost conveyance path 56*a* to the first diverter belt 100, the conveyance path 56*a* is vertically raised relative to the diverter unit 98*a*. This spatial relationship allows the upper load bearing surface 120 to transfer the static load of the underlying mailpiece 22 to the respective drive element 86 (and associated chain drive assembly) of the conveyance path 56*a*. When the mounting fixture 38 moves across the adjoining interface, i.e., between the conveyance path 56*a* and the diverter unit 98*a*, the static load of the escorted mailpiece 22 is now transferred from the upper load bearing surface 120 to the lower bearing surface 122. Furthermore, the static load is then reacted by the belt 100 of the first diverter unit 98*a*. The transverse motion of the mounting fixture 38 and vertical spacing of the load bearing surfaces 120, 122 allows the escorted mailpiece 22 to be transferred without requiring additional structure to carry the escorted mailpiece 22 across the adjoining interface.

Various mechanisms may be employed to urge the mounting fixture 38 across the interface between the outermost conveyance path 56*a* and the first diverter unit 98*a*. In the described embodiment, a sorting signal SS (FIG. 11 *a*) is issued by the controller 50 to divert one of the escorted mailpieces 22 across the interface. One such mechanism 124 may include a rotary actuator (not shown) for driving a circular disk 128, a finger 130 having an elongate slot 132, and a pin 134 disposed about the peripheral edge of the disk 128. The pin 134 engages the slot 132 such that as the disk 128 rotates, the finger 130 is caused to reciprocate back-and-forth in the plane of the mounting fixture 38 and parallel to the transverse grooves 92 of the drive elements 86.

Furthermore, a cantilever spring 136 and linear actuator 138 control the position of the finger 130 such that the finger 130 is vertically lowered in response to the sorting signal SS issued by the controller 50. That is, the finger 130 is vertically lowered to engage a side edge 38SE of the mounting fixture 38 and apply a lateral force vector $V_L$ tending to slide the mounting fixture 38 across the transverse grooves 92 of a drive element 86 to the linear grooves 106 of the diverter belt 100. In the described embodiment, a rotating friction drive wheel 140 may engage an upper edge 38UE of the mounting fixture 38 to the augment the lateral force vector VL, or continue the application or a lateral force vector VL upon exceeding the lateral stroke of the reciprocating finger 130. Furthermore, the drive wheel 140 functions to locate the lower load bearing surface 122 directly under the gravitational force vector acting on the escorted mailpiece 22.

In FIG. 11 *b*, the mounting fixture 38 transitions from the diverter unit 98*a* to the accumulator 99. At this juncture or interface, the diverter and accumulator belts 100, 110 are, for all intents and purposes, coplanar. Although, the diverter belt 100 may be slightly raised relative to the accumulator belt 110 to minimize friction loads, accommodate alignment tolerances and allow the accumulator belt 110 lie directly below the resultant gravitational force vector acting on the mounting fixture 38. Therein, the lower load bearing surface 122 of the mounting fixture 38 disengages the diverter belt 110 as each linear groove 106 rotates around the pulley 102. Accordingly, the mounting fixture 38 assumes a slightly downward inclination (shown in dashed lines) before transitioning to a substantially level or horizontal orientation (solid lines) when coming to rest on the accumulator belt 110.

With each new or additional escorted mailpiece 22, the accumulator belt 110 is incremented by a dimension consistent with the thickness of the respective mailpiece 22. It will be recalled that, when loading each mailpiece 22 into the jaws 32*a*, 32*b* of the escort device 26, the thickness dimension of the mailpiece 22 is measured so that the conveyance/diverter system 40 may reserve/allocate the necessary space, e.g., number of transverse or linear grooves 92, 106 when loading and unloading the escorted mailpieces 22.

In FIG. 11 *c*, the second diverter unit 98*b* is disposed above, extends over and overlaps the opposite end of the accumulator 99. When unloading/dispatching escorted mailpieces 22 from the accumulator 99, an input end $98b_E$ of the second diverter unit 98*b* passes through the open upper end 38Oj of the square-S shaped mounting fixture 38. Furthermore, the diverter belt 100 initially clears or passes under the upper load bearing surface 120 (shown in dashed lines in FIG. 11*c*). When the mounting fixture 38 reaches the end of the accumulator 99, the mounting fixture 38 falls free/away from the accumulator belt 110 to disengage the lower load bearing surface 122 while, at the same time (or immediately thereafter), the upper load bearing surface 120 falls into and engages a linear groove 106 of the diverter belt 100 (shown in solid lines in FIG. 11*c*). Therefore, at this juncture/interface, loads are transferred from the lower to the upper load bearing surface 120 of the mounting fixture 38.

Figure 11D:
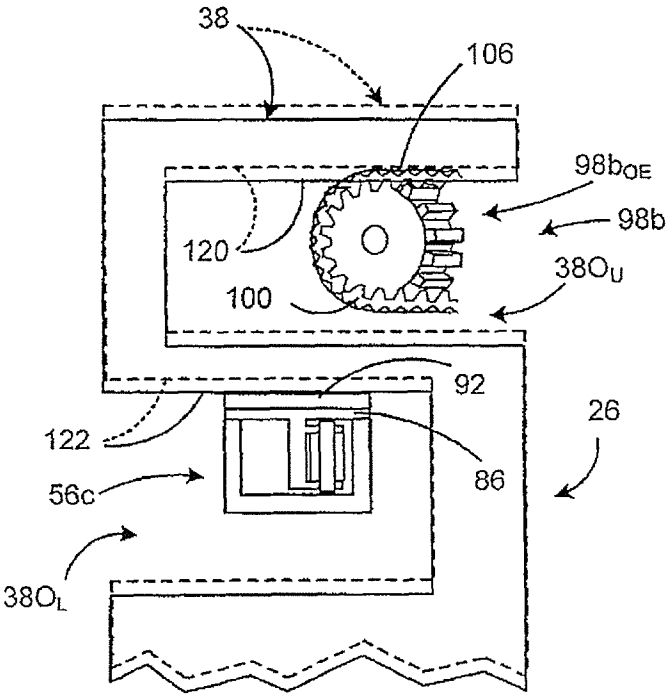
Figure 11C:
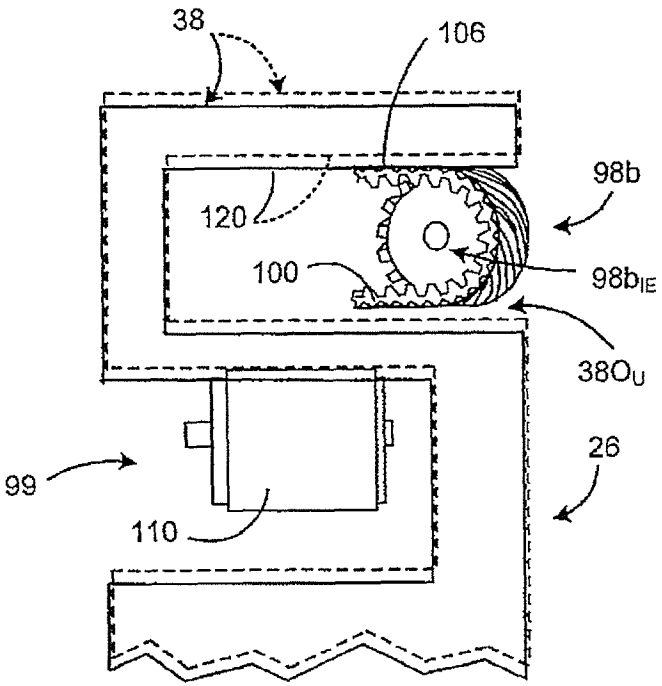

In FIG. 11*d*, the escorted mailpieces 22 cross the juncture/interface from an output end $98D_OE$ of second diverter unit 98*b* to the innermost conveyance path 56*c*. The second diverter unit 98*b* is disposed vertically above the innermost conveyance path 56*c* and, similar to the first diverter unit 98*a*, conveys escorted mailpieces 22 at a resultant velocity sufficient to yield a component (i.e., a component in the direction of the innermost path 56*c*) equal to the velocity of the innermost conveyance path 56*c*. This relationship allows escorted mail 22 to be conveyed without introducing accelerations tending to generate moment loads about the various pitch, roll, and yaw axes P1, RO, VA (see FIG. 9). Furthermore, the linear grooves 106 of the diverter belt 100 are synchronized, or laterally align with, the transverse grooves 92 of the drive elements 86, such that escorted mailpieces 22 can be smoothly transferred to the drive elements 86.

To facilitate transfer across the interface, the open lower end $38O_L$ of the mounting fixture 38 faces or opposes the conveyance path 56*c*. Furthermore, the spatial relationship between the diverter unit 98*b* and the conveyance path 56*c*, i.e., the vertical spacing there between, causes the drive elements 86 of the conveyance path 56*c* to pass beneath the lower load bearing surface 122 of the mounting fixture 38 (shown in dashed lines in FIG. 11*d*). Moreover, the opposing open end $380_L$ of the mounting fixture 38 facilitates access to the lower load bearing surface 122.

As escorted mailpieces 22 approach the conveyance path 56*c*, the mounting fixture 38 falls free/away from the output end $98b_{OE}$ of the diverter belt 100. Furthermore, the upper load bearing surface 120 of the mounting fixture 38 disengages its respective linear groove 106 while, at the same time (or immediately thereafter), the lower load bearing surface 122 falls into and engages a transverse groove 92 of a respective drive element 86 (shown in solid lines in FIG. 11*d*). Therefore, at this juncture/interface, loads are transferred from the upper to the lower load bearing surfaces 120, 122 of the mounting fixture 38.

Figure 10B:
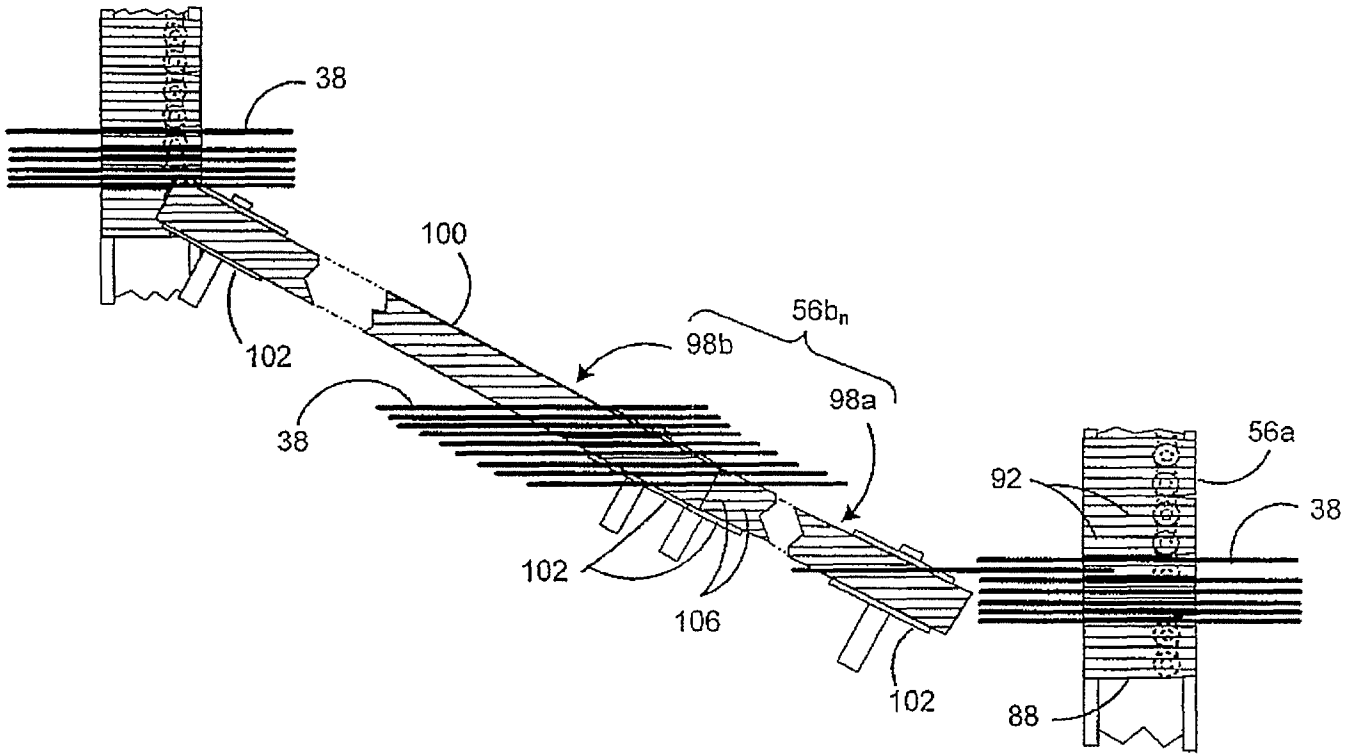
FIG. 10*b* is a segmented, broken-away, top view of the multi-path conveyance/diverter system wherein the central conveyance/storage path includes a pair of end-to-end diverter units.

While, in the described embodiment, each of the central conveyance/storage paths $56b_n$ includes a pair of diverters 98*a*, 98*b* and an accumulator 99, if will be appreciated that this path performs two principal functions, i.e., a path to transfer select mailpieces 22 from one path to another and a storage area to accumulate/hold select mailpieces 22 in preparation for dispatch. Consequently, other structural arrangements may be employed to perform this task. For example, in FIG. 10*b*, the each of the central conveyance/storage paths $56b_n$ may include a pair of diverters 98*a*, 98*b* which are aligned. In the illustrated embodiment, the first diverter unit 98*a* is positioned lower than the second diverter unit 98*b*, though either of the diverter units 98*a*, 98*b* may lie above or below the other depending upon which of the load bearing surfaces 120, 122 is used to carry/convey the escorted mailpieces 22. In this embodiment, the first diverter 98*a* receives select escorted mailpieces 22 from a primary conveyance path 56*a*. The lower load bearing surface 122 may be used to carry the weight of the escorted mailpiece 22 as it travels along the primary conveyance path 56*a* and the upper load bearing surface 120 may be used to suspend the escorted mailpiece 22 following the transition to the diverter unit 98*a*.

The selected escorted mailpieces 22 are then moved to the second diverter unit 98*b* where the mailpieces are stored or buffered, i.e., in preparation for dispatch. Once again, the lower load bearing surface 122 may be used to carry the weight of the escorted mailpiece 22 as it travels along the first diverter unit 98*a* (similar to the arrangement shown in FIG. 11*a*) and the upper load bearing surface 120 may be used to suspend the escorted mailpiece 22 following the following the transition to the second diverter unit 98*b* (similar to the arrangement shown in FIG. 11*d*). Finally, the escorted mailpieces 22 are moved, according to a predetermined dispatch schedule, to the second conveyance path 56*c*. The lower load bearing surface 122 may again be used to carry the weight of the escorted mailpiece during dispatch along the second conveyance path 56*c*.

Raising/Lowering Diverter Units to Facilitate Transport of Escorted Mailpieces

Sorting systems having multiple paths present certain unique obstacles/challenges which are addressed by various features of the inventive conveyance/diverter system 40. For example, in one embodiment, the use of at least two (2) vertically-spaced load bearing surfaces 120, 122 facilitates smooth, uninterrupted transfer by enabling the one belt/path to carry the load of an escorted mailpiece 22 before unloading the adjacent belt/path.

Figure 12A:
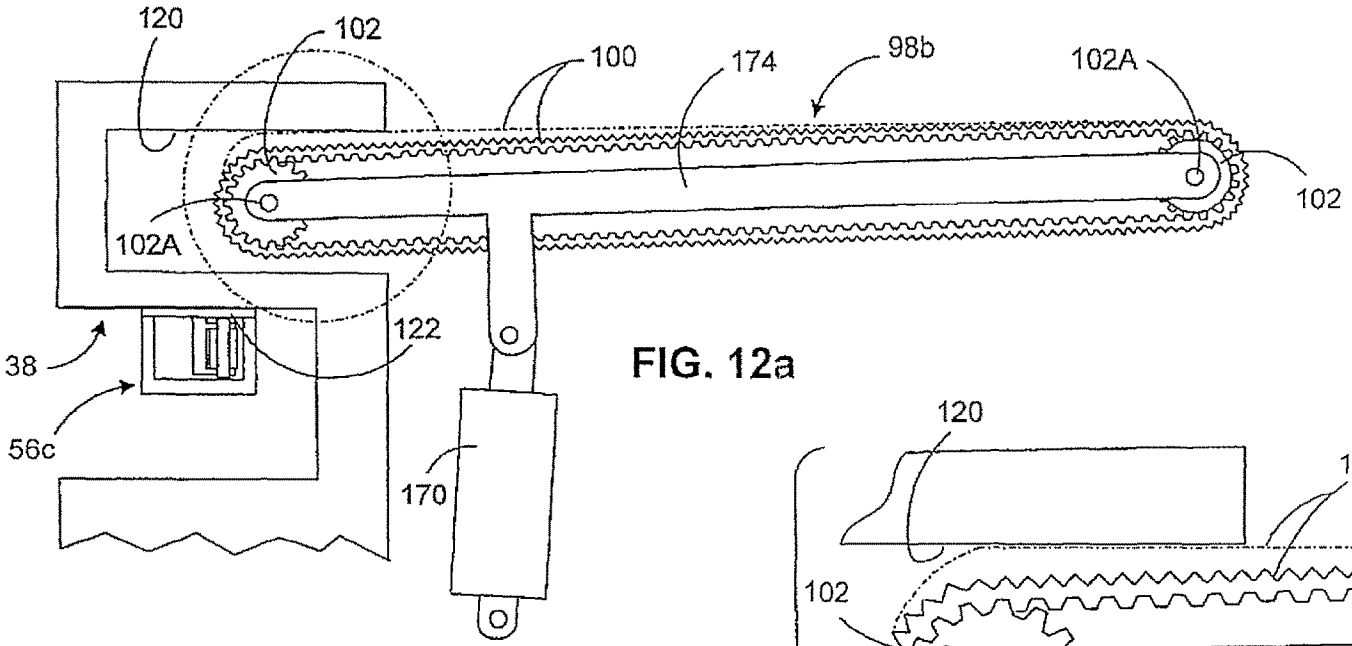
FIG. 12*a* is a side view taken substantially along line 12*a*-12*a* of FIG. 10*a*, of a diverter unit including a means for spatially repositioning the unit to facilitate passage of an escorted mailpiece along a conveyance path.
Figure 12B:
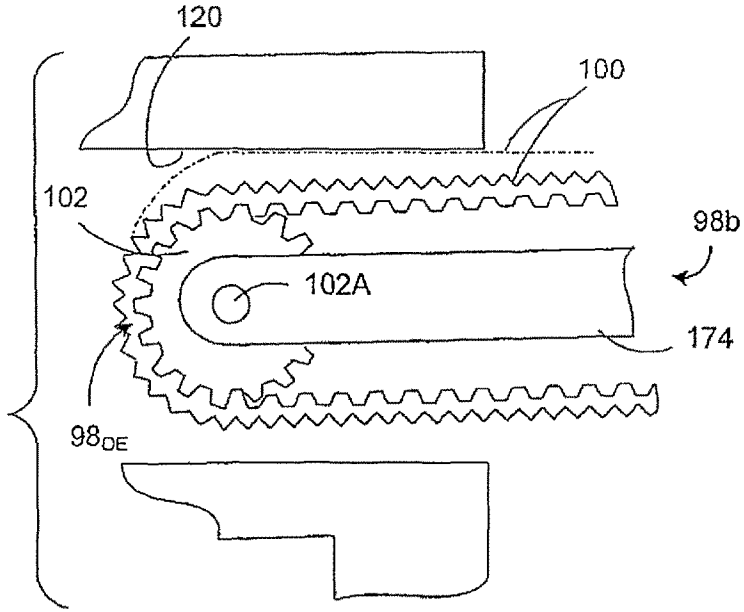
FIG. 12*b* is an enlarged view of an end of the diverter unit depicted in FIG. 12*a*.

In yet another embodiment and referring to FIGS. 11*d*, 12*a* and 12*b*, the second diverter unit 98*b* is spatially repositioned to allow the diverter belt 100 to clear or pass beneath the upper load bearing surface 120, i.e., as the escorted mailpieces 22 are conveyed along the innermost conveyance path 56*c*. Inasmuch as the diverter belt 100 engages the upper load bearing surface 120 while being diverted, the diverter belt 100 is also an obstruction inhibiting the passage of escorted mailpieces 22 disposed upstream of the second diverter unit 98*b* along the conveyance path 56*c*. To enable passage of these escorted mailpieces 22, an actuator 170 may be employed to lower the output end $98_{OE}$ of the second diverter unit 98*b* such that the mounting fixture 38 passes over the diverter belt 100. More specifically, a structural plate or yoke assembly 174 (see FIG. 12*a*) may be connected to the axis 102A of one or both diverter pulleys 102, and pivotally mounted to the actuator 170. Furthermore, the output end 98OE of the diverter unit 98*b* may be displaced relative to the upper and lower load bearing surfaces 120, 122 such that each escorted mailpiece 22 passes the output end $98_{OE}$ of the diverter unit 98*b* without obstruction.

Escort Bin for Escorting Pre-Sorted Trays of Mail

As discussed in the Background of the Invention, mail is generally received at a distribution center in one of several varieties. Collection mail is one variety and includes mail retrieved from mailboxes in the local/surrounding area. Another variety includes in-bound mail arriving from other sorting centers. Yet another type includes pre-sorted mail from large volume/bulk mailers. This mail generally has been organized and placed in trays to receive discounts in accordance with the USPS Manifest Mailing System (MMS). Pre-sorted mail may be destined for delivery to another distribution center (i.e., pre-sorted to a three-digit code as outbound mail) or may have reached its final destination (i.e., three digit location). When delivered, the pre-sorted mail is then ready to be incorporated intermixed with the other collection of in-bound mail for sorting to delivery sequence.

Figure 13:
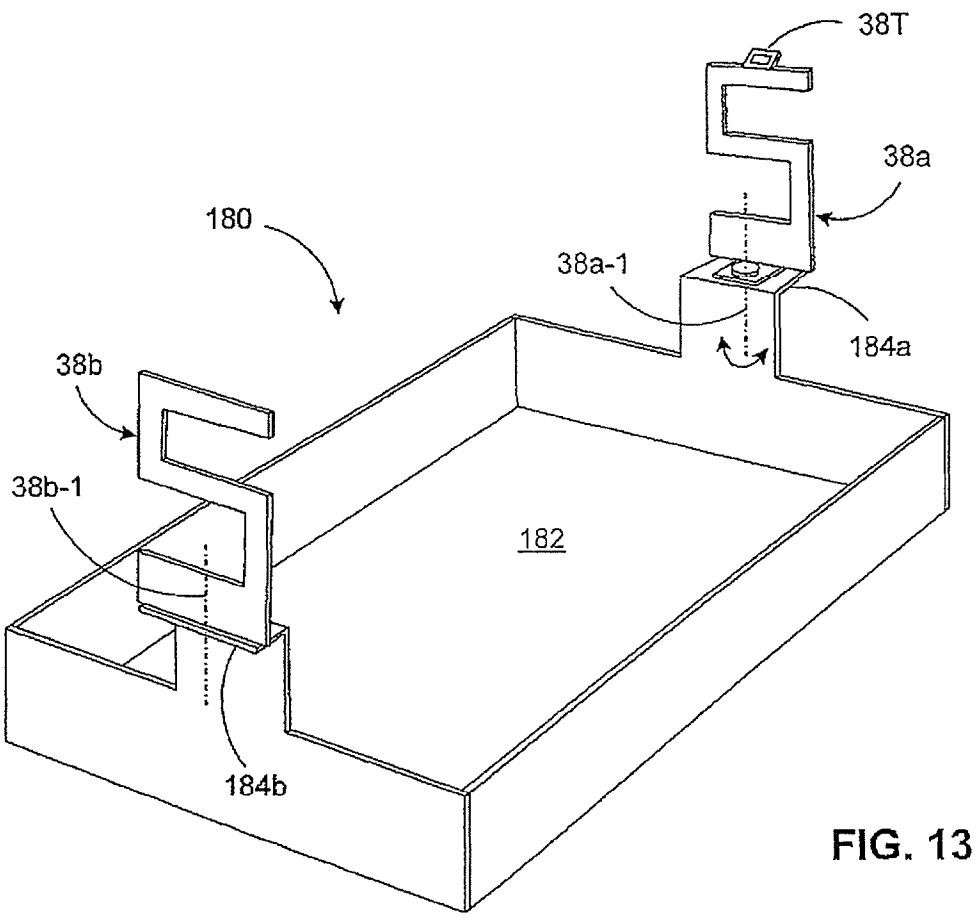
FIG. 13 is an isolated perspective view of an escort bin for accepting a tray of pre-sorted mailpieces.

When trayed, pre-sorted mail is destined for delivery to another distribution center, the conveyance/diverter system may be adapted to sort and store the mail as a unit, i.e., without the requirement to singulate and load each mailpiece into an individual escort device. More specifically, and referring to FIG. 13 an escort bin/tray 180 may be used in combination with the conveyance/diverter system of the present invention for receiving and escorting an entire tray of pre-sorted mail (not shown) therein. The escort bin 180 includes a lightweight structural container 182 which is suspended from the conveyor/diverter system 40 above using the same type of escort mounting fixture 38 described earlier in connection with a single/individual mailpiece. In the described embodiment, a pair of mounting fixtures 38*a*, 38*b* is connected to horizontal flanges 184*a*, 184*b* formed at each end of the structural container 182. Moreover, the mounting fixtures 38*a*, 38*b* are pivotally connected to the flanges 184*a*, 184*b* such that the fixtures 38*a*, 38*b* may pivot or rotate about vertical yaw axes 38*a*-1, 38*b*-2. Furthermore, at least one of the escort fixtures 38*a* includes a unique identifier, e.g., a tab 38T for displaying a two-dimensional barcode, such that the system controller 50 can establish a relationship between the escort bin 180 and the trayed, pre-sorted mail.

In operation, the mounting fixtures 38*a*, 38*b* engage the conveyance/diverter system 40 in a manner similar to the individual escort devices 26 previously described. Inasmuch as the escort bins 180 are used for sorting and storing mail destined for delivery to other sorting centers, i.e., outbound mail, these escort bins, 180 may be used exclusively used in the outbound sorting bank 20B (see FIG. 2). Rather than singulating and reading the individual mailpieces within the trayed, pre-sorted mail, the system controller 50 reads the accompanying documentation, e.g., the mailing manifest or an identifying tag on the tray, to create the association/relationship between the escort bin 180 and the tray of pre-sorted mail. After reading/scanning the tray identification information, the EBS system 20 conveys the escorted tray of pre-sorted mail to the proper storage area 56*a*, 56*b*, 56*c* in one of the destination storage modules 54DE (see FIGS. 4*a*-4*c*) of the outbound sorting bank 20B. Inasmuch as the mail is "pre-sorted" and there is no additional requirement to sort individual mailpieces to another level of sortation, e.g., to delivery sequence, the escort bins 180 can be moved and stored as a unit within the EBS system 20, i.e., as if the pre-sorted tray of mail were a single mailpiece. Furthermore, during sorting operations the escort bins 182 may be intermixed with individual escorted mailpieces 22 suspended from the various conveyance paths and storage areas of the conveyance/diverter system 40.

Generally, an escort bin 180 will move along a linear path, though, at times, the escort bin 180 will cross an interface/juncture e.g., between an elevator and one of the destination storage modules 54DE, or traverse an arcuate path e.g., a path around a sprocket of the distribution loop 66. Such non-linear motion is accommodated by the pivot connection between each of the mounting fixtures 38*a*, 38*b* and the respective one of the flanges 184*a*, 184*b*. That is, a change in direction caused by, for example, a right-angle turn or movement in a circular path, is accommodated by allowing the mounting fixture 38*a*, 38*b* to follow the angle/orientation of a transverse or linear groove 92, 106 while the escort container 182 below seeks an orientation consistent with the distance between the rotational axes 38*a*-1, 38*b*-2 of the fixtures 38*a*, 38*b*. Consistent with our earlier discussion in connection with use of the squared-shape, each mounting fixture 38*a*, 38*b* transfers the load of the escorted tray to the conveyor/diverter system 40 by alternately employing the vertically-spaced load bearing surfaces 120, 122 to move the escort bin 180 across multiple paths. Furthermore, each of the load bearing surfaces 120, 122 of each mounting fixture 38*a*, 38*b* are arranged such that at least a portion thereof intersects a vertical plane passing through the gravitational center of the tray of escorted mail, i.e., the combination of the escort bin 180, container 182 and presorted tray of mail (not shown).

While the escort bin 180 is shown to include a pair of mounting fixtures 38*a*, 38*b* disposed at each end of the escort container 182, it will be appreciated that the container 182 may be suspended from a single, centrally located mounting fixture 38. For example, a single mounting fixture 38 may be articulately mounted to a central/common node of a structure which employs multiple arms extending outwardly, i.e., in a radial direction, to each corner or side of the escort container 182. Furthermore, while the connection between the mounting fixtures 38*a*, 38*b* and the escort container 182 is shown as a vertical pivot mount, it will be appreciated than any one of a variety of articulating mounting arrangements may be employed to provide the necessary degree(s) of freedom. The only requirement is that a rotational degree of freedom about a vertical axis is provided whenever two or mounting fixtures are employed to suspend an escort container 182.

Communication Network for Workload Leveling

In an alternative embodiment of the invention, a communication network (not shown in the figures) may be established to link a plurality of sorting centers 10. In this embodiment, the system controller 50 determines the number of outbound mailpieces 22 destined for delivery to each of the networked sorting centers. Such information is available inasmuch as the scanned/optically obtained mailpiece information can be used to track the actual number of outbound mailpieces 22 loaded into the EBS system 20. This information may indicate that a sorting center should be prepared to receive an unusually large volume of mail 22 on a given day or, alternatively, that an unusually light mail day may be expected.

Based upon this information, the system controller 50 may be adapted to communicate the anticipated volume data for the purpose of resource/personnel planning. Likewise, information about the volume of mail destined for each specific route may be communicated via the communication network to the distribution offices to identify work leveling opportunities. For example, a postal carrier of a lightly-loaded route may be reassigned to assist a carrier having a heavily-loaded route to enable more efficient use of the labor force. This same mail volume information may be used to optimize the number of vehicles required for transporting the mail to other distribution/sorting centers and/or delivery offices. Similarly, information concerning the number of destination addresses which will receive mail on a particular day can be tracked and conveyed to the delivery office. That is, information related to the number of addresses receiving mail based upon the class of delivery service can be communicated to plan mail carrier deliveries on a particular day.

Control of Sorting Center Operations for Delivery Optimization

Of the various costs involved in mailpiece delivery, one of the more costly efforts relates to the "last mile" of delivery, i.e., the cost for a mail carrier to physically deliver the mail to a customer's home/mailbox. Approximately fifty to sixty percent (50% to 60%) of the total cost of delivery may be attributable to this step of the delivery process. In yet another embodiment of the invention, the controller 50 of the EBS system 20 may be adapted to segregate/separate various classes of mail such that the number of destination addresses receiving mail on a particular day is reduced. The system controller 50 can also effect this reduction without requiring any change to the current logistics employed in the delivery of mail.

To better understand the control algorithms applied by the EBS system 20, it is useful to understand how various classes of mail are currently managed within the postal system. First class mail, when selected by a customer, is perhaps one of the most costly methods to deliver mail. The high cost is attributable to the requirement, or expectation by the customer, that first class mail will be delivered within the next one (1) or two (2) business/delivery days. Standard class mail, on the other hand, is becoming a more common class of mail and generally is delivered within the next three (3) to five (5) business/delivery days. Consequently, some mail may be delivered in one (1) or two (2) days, i.e., first class mail, while other mail may be delivered over the course of five (5) days, i.e., standard class mail. Other classes of mail exist, e.g., bulk mail, which carry yet other delivery requirements/expectations.

In view of the logistic and cost differences, the EBS system 20 of the present invention may be adapted to operate within the current practices, yet provide an opportunity to reduce the number of destination addresses that a mail carrier delivers on any particular day. In this embodiment of the invention, the mailpiece destination and mail class information is scanned and stored within the controller 50. This step does not require additional data collection or manipulation inasmuch as all of the mailpieces 22 are initially read by the optical scanning device 30 (depicted in FIG. 3) Alternatively, the class of delivery service may be entered manually by an operator in the process of loading mail into the sorting banks 20A, 20B, i.e., at the input stations 12. Whether the system controller 50 determines the class of delivery service or has received the delivery service information by manual input, the system controller 50 determines when the escorted mailpiece 22 must be dispatched to reach its destination within a target time period. Co-pending, commonly-owned patent U.S. patent application Ser. No. 11/544,349, filed 6 Oct. 2006 entitled "Mail Sorter System and Method for Productivity Optimization Through Precision Scheduling" and U.S. patent application Ser. No. 11/544,184 filed 6 Oct. 2006 entitled "Mail Sorter System and Method for Moving Trays of Mail to Dispatch in Delivery Order" each describe a method for determining a dispatch time or schedule to facilitate this step.

The system controller 50 will determine whether a particular address will receive mail having different classes of delivery service, for example the controller may determine whether a particular mailing address will receive: a) first class mail only, b) standard class mail only or c) a combination of both first and standard class mail. If the destination address is receiving first class mail only, or a combination of first and standard class, then the controller 50 schedules this mail for dispatch within the first twenty-four hour time interval. Hence, this mail is processed by the sorting banks 20A in the manner previously described, i.e., from the large batch storage modules in the upper tier 58U and finally to delivery sequence in the lowermost tier 58L. If the destination address is receiving standard class mail only, then an opportunity may exist to hold such mail until a subsequent interval of time within the EBS system 20. That is, since several days are afforded/available to deliver standard class mail, the EBS system 20 may be adapted to out-sort this mail once it has been sorted to delivery sequence. Of course, if the destination address is receiving standard class mail only, but it is the last remaining day before delivery must be made, e.g., the standard class mail has been retained for the maximum period or the five (5) day requirement is subject to expire, then the standard class mail will be delivered nonetheless.

Figure 14:
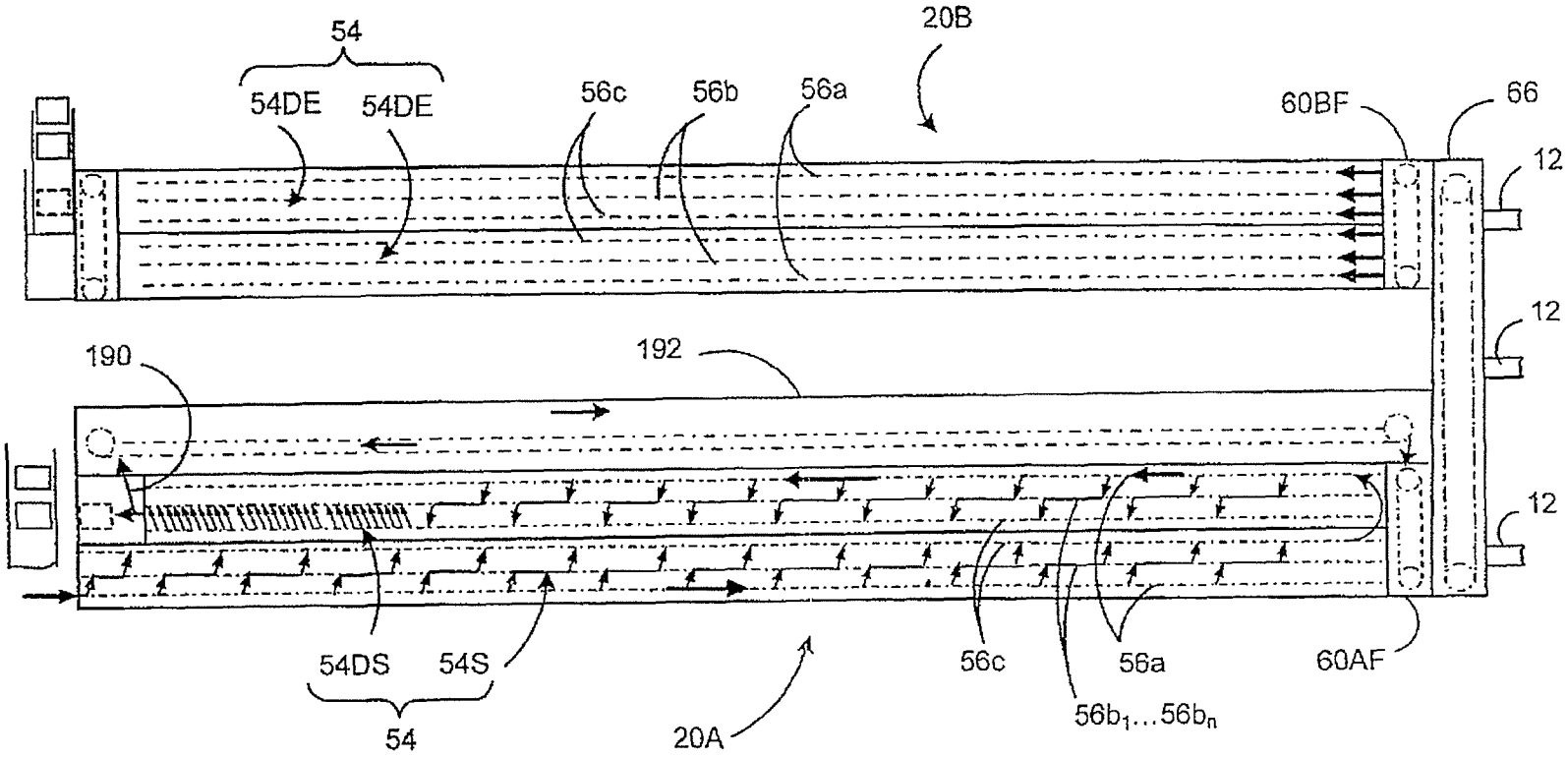
FIG. 14 is a view taken substantially along line 14-14 of FIG. 2 depicting an alternate embodiment of the lowermost tier of the sorting bank wherein a buffer module is provided to store escorted mailpieces which have been designated for dispatch on a subsequent phase/cycle of sorting operations.

More specifically, in FIG. 14, the controller 50 identifies those mailpieces, e.g., standard class mailpieces, which can be delayed without adversely impacting the delivery of other mail, i.e., to the same address Upon dispatch of the large batch containing these mailpieces, the controller 50 issues an out-sort signal to a diverter unit 190 to out-sort those mailpieces which are not to be trayed for delivery. The diverter unit 190 may be located at any point along the conveyance path taken by the large batch, though in the described embodiment, the diverter unit 190 is located aft of the sort-to-delivery sequence modules 54DS in the lowermost tier 58*l*_ of the sorting bank 20A. To provide a temporary storage location, the EBS system 20 may include a buffer module 192 disposed adjacent the sorting bank 20A to retain the selected mailpieces. Alternatively, these mailpieces may be returned to one of the large batch storage areas $\mathbf{54}_L$ as a group to await one of the next or subsequent sorting operations. Notwithstanding the location for storing the outsorted mailpieces, these mailpieces remain in the EBS system 20 without exiting one of the sorting banks 20A, 20B or re-loading the mailpiece into an escort device 21.

Figure 15:
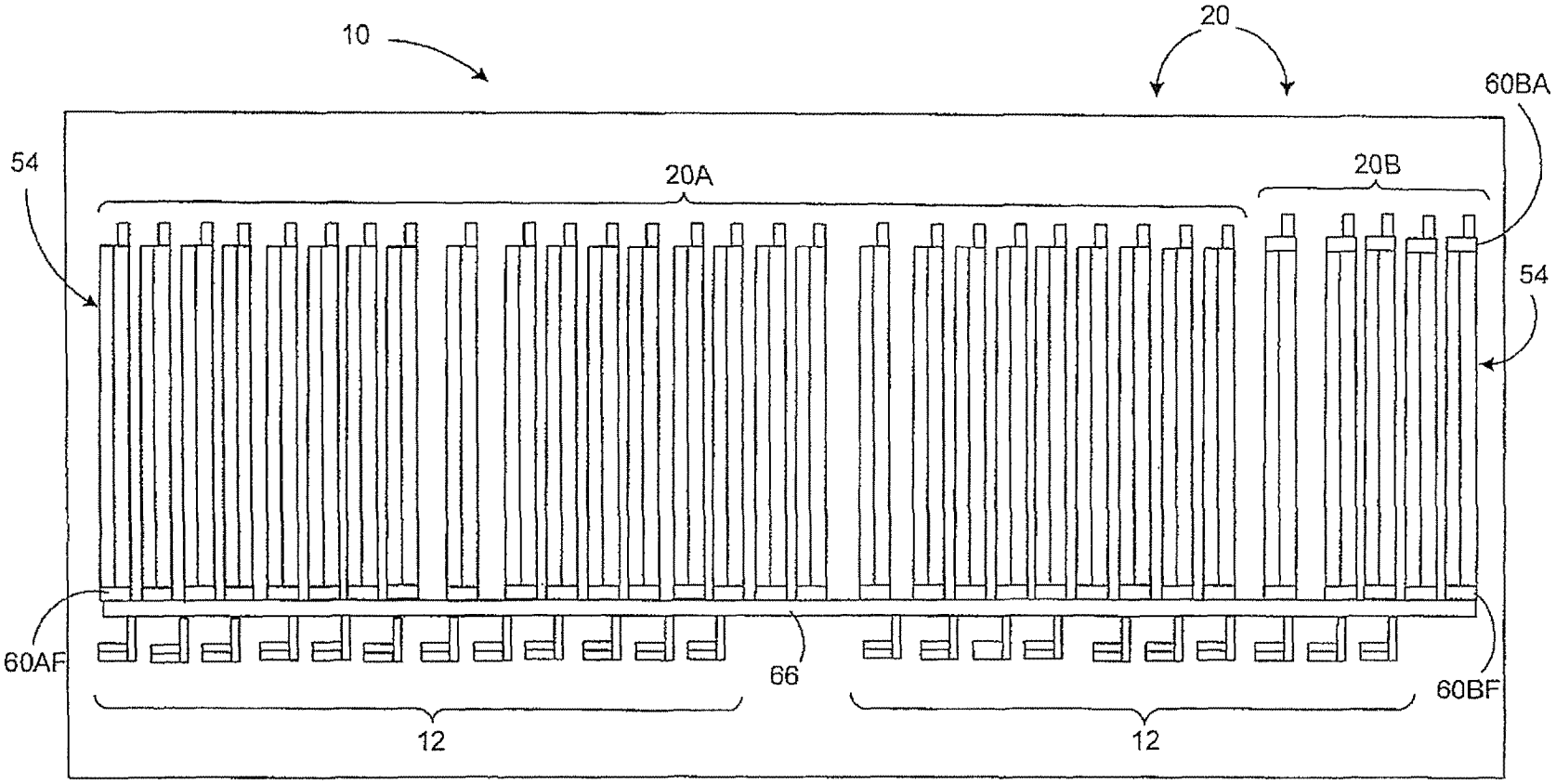
FIG. 15 is a top view of a sorting center according to the present invention including sorting banks for both inbound and outbound mail.

FIG. 15 shows a top view of an exemplary sorting and distribution center 10 according to the present invention. The EBS system 20 of the center includes thirty-one (31) sorting banks 20A, 20B wherein twenty-six (26) banks 20A thereof are dedicated to sort and store inbound mail and five (5) banks 20B are dedicated to sort and store outbound mail. The number of each type of sorting bank is determined by the anticipated maximum daily mail volume, the number of delivery routes and number of outbound destinations serviced by the sorting and distribution center 10.

A plurality of input stations 12 convey mailpieces, via a distribution conveyor system 66, to end elevators 60AF, 60BF and/or to and finally to the sorting modules 54 disposed in rows and tiers. The sorting banks 20B dedicated to sorting outbound mail 22 includes elevators 60BA, 60BF at both ends of the sorting modules 54 to permit continuous feeding and dispatch. A sorting center 10 of this size/proportion is capable of sorting a maximum of about seven million (7,000,000) mailpieces over the course of a twenty-four (24) hour time period.

During the first phase of sorting operations (i.e., loading mail into each of the sorting banks 20A, 20B and sorting the mail into larges batches of inbound and outbound mail), the EBS system 20 collectively operates as a single sorter. That is, each of the input stations 12 is operatively coupled to all of the sorting banks 20A, 20B by a distribution system 66, i.e., a continuous loop or conveyance system which returns to retrieve other mailpieces. A mailpiece may travel from a first input station 12 at one end of the EBS system 20 to a sorting bank at the opposite end of the EBS system 20. The time required for loading/sorting/storing a particular mailpiece will, therefore, be a function of its length of travel multiplied by the speed of travel along each of the various paths (e.g., a relatively constant value of about fifteen (15) feet per minute). Hence, on input, a mailpiece may travel a relatively long distance, i.e., across all of the sorting banks 20A, 20B (via the distribution conveyance system 66) and along the full length of a large batch storage area, before reaching its final destination. Additionally, a mailpiece may be delayed at an input station 12 to await the availability of space within the distribution conveyance system 66, i.e., the relationship between the number of distribution loops/paths to the number of input stations 12 will generally be a fraction less than the number one (1).

Although, to keep the various conveyance paths of the EBS system 20 in relatively constant/uniform motion, i.e., to prevent wear induced by acceleration/deceleration of the large mass of escorted mail, buffer stations (not shown) may be interposed between each input station 12 and the distribution conveyance system 66 and/or between the distribution conveyance system 66 and each elevator 60AF, to assist the control/flow of mail. Upon reaching the appropriate large batch storage area, mailpiece awaits its designated dispatch time. As mentioned earlier, the time of dispatch may be any time for outbound mail or after the completion of the first phase of sorting operations for inbound mail.

During the second phase of sorting operations, each of the banks 20A, 20B operates independently of one another or in parallel. With respect to inbound sorting banks 20A, on output, a mailpiece travels a relatively short distance, i.e., across a large batch storage area, a length equivalent to the cumulative total of the small batch storage areas and through the sort-to-delivery sequence module(s). Furthermore, during dispatch the mail is immediately escorted from each of the sorting bank 20A to dispatch conveyors 70 (see FIG. 2). That is, the relationship between the number of distribution conveyors 70 to the number of sorting stations 20A, 20B will generally be an integer equal to the number one (1).

Inasmuch as each of the sorting banks 20A, 20B are operated in parallel, i.e., without interfering with other mail being loaded or dispatched, the total volume of inbound mail, loaded over the relatively long time interval of the first phase, can be sorted to delivery sequence over a relatively short time period i.e., approximately one-eighth (⅛th) of the total daily allotment of time associated with the second phase.

In summary, and referring collectively to the FIGS. 2-15, the EBS system 20 of the present invention is a direct sorting system. Inasmuch as each mailpiece transfer, i.e., from one path to another, effects another level of sort, there is no requirement to remove mailpieces from the sorter until they are sorted to the level required (i.e., to delivery sequence for inbound mail and to destination for outbound mail). It will be recalled that with prior art sorting systems which utilize a RADIX sorting algorithm, multiple passes through the sorter are typically required and, with each pass, all mailpieces must be removed from and returned to the sorter in a precise order.

The EBS system 20 operates as a single sorter during the first phase of sorting operations and as a plurality of independent sorters during the second phase of sorting operations. That is, the parallel arrangement of the sorting banks 20A, 20B provides for continuous loading/sorting of mail over a long time interval, i.e., during the first phase of sorting operations, while facilitating rapid dispatch over a relatively short period i.e., during the second phase of sorting operations.

The EBS system 20 scans, interprets and measures various characteristics of the mailpieces which have been loaded into the sorter (e.g., the number of mailpieces destined for a specific country, sorting center, route, address, mailpiece thickness, etc.) and can use this information to communicate mail volume, transport requirements and staffing requirements at the present or remote sorting centers.

The EBS system 20 is capable of accepting mailpieces of a mixed variety, i.e., flats, letter, tabbed, postcard, newspaper, magazine, etc. All varieties of mailpieces 22 may be processed by the EBS system 20 with no further requirement for manual presorting into various categories (e.g., machinable/non-machineable, flats/letters, inbound/outbound, etc. Inasmuch as the mailpieces are escorted through the EBS system 20, many mailpieces previously considered non-machineable are now machineable. In addition to sorting all varieties of mail, the EBS system 20 sorts inbound mail to delivery sequence, i.e., the mail organized according to the route taken by the mail carrier. As such, the requirement for mail carriers at the local post/delivery offices to combine/merge different types of mail and sort the same to delivery sequence is substantially reduced.

The EBS system 20 is capable of receiving and storing pre-sorted mail within the sorting banks 20B without the need to unload and singulate mailpieces from the pre-sort trays used by volume/bulk mailers. While prior art distribution centers must often use temporary storage locations for pre-sorted mail, the EBS system employs escort bins to convey, sort and store entire trays of presorted mail. An escort bin functions similarly to an escort device inasmuch as the system controller affects a relationship between the bin and the trayed, presorted mail. Inefficiencies are avoided by scanning information contained on the mailing manifest (or an ID tag on the tray) rather than acquiring information from each individual mailpiece. Furthermore, during sorting operations the escort bins 182 may be intermixed with individual escorted mailpieces 22 suspended from the various conveyance paths and storage areas of the conveyance/diverter system 40.

Inasmuch as the EBS system 20 scans, reads, and interprets each ingested mailpiece or tray of presorted mail, the manual presort operations of the prior art are essentially eliminated. For example, since the EBS system 20 accepts all varieties of mailpieces, the requirement to separate letters from flats type mail or manually cull non-machineable mailpieces from those which may be processed by automated equipment is substantially eliminated. The further requirement to separate inbound mail (i.e., mail destined for delivery to a local post/delivery office within the predefined jurisdiction of the present sorting center) from outbound mail (i.e., mail to be delivered to another sorting center) is also moot inasmuch as the sorter performs these tasks and sends each to dedicated portions or segments of the EBS system 20.

The EBS system 20 essentially eliminates the need for much of the peripheral equipment within the sorting center. That is, since the mail remains within the EBS system 20 at all times, the requirement for conveyor/transport systems, tray storing, lifting and retrieval systems or manual sorting stations no longer exist. Furthermore, since the EBS system 20 processes mail of all types, the requirement for multiple sorting systems dedicated to process a particular type of mail, e.g., flats sorters, letter sorters, etc., may be eliminated.

Consequently, the capital equipment, real estate and labor costs are eliminated, mitigated or substantially reduced.

The conveyance/diverter system 40 and escort device 26 therefor, enables smooth, uninterrupted transfer of escorted mailpieces 22 across the various conveyance/storage paths 56*a*, 56*bi* . . . , 56$b_n$, 56*c*. Moreover, the conveyance/diverter system 40 is adapted to (i) minimize wear due to friction, (ii) eliminate the use of dynamic friction loads to convey/retain the mounting fixtures 38, and (iii) minimize the generation of moment loads about pitch, roll and yaw axes of each escorted mailpiece 22. In this regard, the conveyance/diverter system 40 employs a variety of grooved drive elements 88 and belts 100, 112 to react/transfer static loads into the mounting fixture 38. The transverse and linear grooves 92 and 106 are linear and elongate to inhibit the generation of moment loads about a vertical yaw axis. The upper and lower load bearing surfaces 120, 122 are vertically spaced, and intersect a vertical line passing through the Center-of-Gravity (CG.) of the escorted mailpiece 22, to prevent the introduction of moment loads about a horizontal roll axis (i.e., in the direction of a conveyance path). Moreover, the diverter units 98*a*, 98*b* define an acute angle with respect to an adjacent conveyance path and move a select one of the escorted mailpieces 22 at a speed optimized to prevent disruption to neighboring mailpieces 22 conveyed along the conveyance path. As such, moment loads about a horizontal pitch axis, i.e., parallel to the transverse grooves 92 are eliminated.

The EBS system may communicate the volume of mail to be delivered or whether mail will be delivered to a destination address for a particular day. Inasmuch as the EBS system receives information regarding the number of mailpieces to be delivered and/or the class of delivery services the EBS system is capable of communicating information which facilitates personnel/staffing and/or which address destinations will receive mail on a particular day.

It is to be understood that all of the present figures, and the accompanying narrative discussions of preferred embodiments, do not purport to be completely rigorous treatments of the methods and systems under consideration. For example, while the invention describes an interval of time for completing a phase of sorting operations, it should be appreciated that the processing time may differ. A person skilled in the art will understand that the steps of the present application represent general cause-and-effect relationships that do not exclude intermediate interactions of various types, and will further understand that the various structures and mechanisms described in this application can be implemented by a variety of different combinations of hardware and software, methods of escorting and storing individual mailpieces and in various configurations which need not be further elaborated herein.

What is claimed is:

1. A conveyance/diverter system for selectively transferring escorted mailpieces across multiple paths, comprising:

a first path structured to receive escorted mailpieces to be sorted and stored in batches;

a second path structured to dispatch escorted mailpieces previously stored and sorted;

a plurality of central paths disposed between the first and second paths, each of the central paths operative to receive select escorted mailpieces and store the escorted mailpieces in batches; and a controller operatively coupled to the first path, the second path and the plurality of central paths, the controller structured and arranged to control:

the first path to receive escorted mailpieces to be sorted and stored in batches;

the second path to dispatch escorted mailpieces previously stored and sorted; and each of the central paths to receive select escorted mailpieces and store the escorted mailpieces in batches, wherein the first path includes a plurality of transverse grooves for accepting a mounting fixture of each escorted mailpiece, and wherein each of the central paths includes a plurality of linear grooves for accepting a mounting fixture of each escorted mailpiece selected to be sorted and stored.

2. The conveyance/diverter system according to claim 1, wherein each of the central paths includes a first diverter unit which the controller operatively controls to receive select escorted mailpieces from the first path, and a second diverter unit operative to dispatch the select escorted mailpieces to the second path.

3. The conveyance/diverter system according to claim 2, wherein the second diverter unit is operatively controlled by the controller to store select escorted mailpieces in batches.

4. The conveyance/diverter system according to claim 2, further comprising an accumulator interposed between the first diverter unit and the second diverter unit, the accumulator being operatively controlled by the controller to store select escorted mailpieces from the first diverter unit in batches.

5. The conveyance/diverter system according to claim 2, wherein the first diverter unit and the second diverter unit each define a diverter path, the diverter path defining an acute angle relative to each of the first and second paths.

6. The conveyance/diverter system according to claim 1, wherein the plurality of linear grooves are parallel to, and aligned with, the plurality of transverse grooves for transferring mailpieces from the first path to each of the central paths.

7. The conveyance/diverter system according to claim 1, further comprising an escort device being operatively controlled by the controller to retain and escort each mailpiece relative to the various paths and wherein the escort device includes at least two load bearing surfaces which are vertically spaced, each of the load bearing surfaces operative to engage one of the paths upon being conveyed across adjacent paths.

8. The conveyance/diverter system according to claim 1, wherein one of the paths is elevated relative to an adjacent path such that each path is vertically aligned with and engages a load bearing surface of the escort device during transfer of the escorted mailpiece.

9. The conveyance/diverter system according to claim 6, wherein each of the central paths include a diverter belt having a width dimension, and wherein the linear grooves are disposed diagonally across width dimension of the diverter belt.

10. The conveyance/diverter system according to claim 9, wherein the first and second paths include a drive chain assembly for driving a plurality of tandemly-arranged drive elements, and wherein the transverse grooves are disposed along a top face surface of each drive element.

11. The conveyance/diverter system according to claim 1, wherein the first path is operatively controlled by the controller to sort the mailpieces into larger batches, which are then transported to a subsequent path which is operatively controlled by the controller to sort the mailpieces from the larger batches into smaller batches.

12. The conveyance/diverter system according to claim 11, wherein the controller controls the first path and the subsequent path to sort the smaller batches into delivery sequence.

13. The conveyance/diverter system according to claim 12, wherein inbound and outbound mailpieces are comingled upon initially being inserted into a sorter, and then the sorter is operatively controlled by the controller to, in a first phase, sort the inbound mailpeices into the larger batches and the outbound mailpieces into a delivery office destination in the first path.

14. A conveyance/diverter system for selectively transferring escorted mailpieces across multiple paths, comprising:

a first path operative to receive escorted mailpieces to be sorted and stored in batches;

a second path operative to dispatch escorted mailpieces previously stored and sorted;

a plurality of central paths disposed between the first and second paths, each of the central paths operative to receive select escorted mailpieces from the first path, store the escorted mailpieces in batches, and convey the select escorted mailpieces to the second path upon dispatch; and a controller operatively coupled to the first path, the second path and the plurality of central paths, the controller structured and arranged to control:

the first path to receive escorted mailpieces to be sorted and stored in batches;

the second path to dispatch escorted mailpieces previously stored and sorted; and each of the central paths to receive select escorted mailpieces from the first path, store the escorted mailpieces in batches, and convey the select escorted mailpieces to the second path upon dispatch, wherein the first path is structured to accept a mounting fixture of each escorted mailpiece, wherein each of the central paths is structured to accept a mounting fixture of each escorted mailpiece selected to be sorted and stored, and wherein each of the central paths includes first and second diverter paths and a central accumulator path, the diverter paths extending between each of the first and second paths and an end of each of the central accumulator path, the first diverter path being controlled by the controller to transfer the select escorted mailpieces from the first path to the central accumulator path, the central accumulator path controlled by the controller to store the escorted mailpieces, and the second diverter path controlled by the controller to dispatch the stored mailpieces from the central accumulator path to the second path.

15. The conveyance/diverter system according to claim 14, wherein the first path is an input conveyance path for loading escorted mailpieces, tend the second path is an output conveyance path for dispatching escorted mailpieces.

16. The conveyance/diverter system according to claim 14, wherein the central path includes a diverter path, the diverter path defining an acute angle relative to each of the first and second paths.

17. The conveyance/diverter system according to claim 14, wherein the first path includes a plurality of transverse grooves for accepting a mounting fixture of each escorted mailpiece, wherein the central path includes a plurality of linear grooves for accepting a mounting fixture of each escorted mailpiece selected to be sorted and stored, and wherein linear grooves are parallel to, and aligned with, the transverse grooves for transferring mailpieces from the first path to the central path.

18. The conveyance/diverter system according to claim 14, wherein the first path is controlled by the controller to sort the mailpieces into larger batches, which are then transported to a subsequent path which is controlled by the controller to sort the mailpieces from the larger batches into smaller batches, and the controller controls the first path and the subsequent path to sort the smaller batches into delivery sequence.

19. A conveyance/diverter system for selectively transferring escorted mailpieces across multiple paths, comprising:

a first path operative to receive escorted mailpieces to be sorted and stored in batches;

a second path operative to dispatch escorted mailpieces previously stored and sorted;

a plurality of central paths disposed between the first and second paths, each of the central paths operative to receive select escorted mailpieces from the first path, store the escorted mailpieces in batches, and convey the select escorted mailpieces to the second path upon dispatch; and a controller operatively coupled to the first path, the second path and the plurality of central paths, the controller structured and arranged to control:

the first path to receive escorted mailpieces to be sorted and stored in batches;

the second path to dispatch escorted mailpieces previously stored and sorted; and each of the central paths to receive select escorted mailpieces from the first path, store the escorted mailpieces in batches, and convey the select escorted mailpieces to the second path upon dispatch, wherein the first path is structured to accept a mounting fixture of each escorted mailpiece, wherein each of the central paths is structured to accept a mounting fixture of each escorted mailpiece selected to be sorted and stored, wherein the first path includes a plurality of transverse grooves for accepting the mounting fixture of each escorted mailpiece, and wherein each of the central paths includes a plurality of linear grooves for accepting the mounting fixture of each escorted mailpiece selected to be sorted and stored.

* * * * *